US008326166B2

(12) United States Patent
Yanagi

(10) Patent No.: US 8,326,166 B2
(45) Date of Patent: Dec. 4, 2012

(54) IMAGE FORMING APPARATUS

(75) Inventor: Yuya Yanagi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 284 days.

(21) Appl. No.: 12/787,049

(22) Filed: May 25, 2010

(65) Prior Publication Data

US 2010/0303488 A1 Dec. 2, 2010

(30) Foreign Application Priority Data

May 29, 2009 (JP) ..... 2009-130218
Mar. 31, 2010 (JP) ..... 2010-080986

(51) Int. Cl.
*G03G 15/06* (2006.01)

(52) U.S. Cl. ..... 399/55; 399/45; 399/53; 399/66; 399/302

(58) Field of Classification Search ..... 399/45, 399/53, 55, 66, 302
See application file for complete search history.

(56) References Cited

U.S. PATENT DOCUMENTS

2010/0284705 A1* 11/2010 Aoki et al. ..... 399/66

FOREIGN PATENT DOCUMENTS

JP 2004-302308 A 10/2004
JP 2007-147758 A 6/2007
JP 2007-328094 A 12/2007

* cited by examiner

*Primary Examiner* — Ryan Walsh

(74) *Attorney, Agent, or Firm* — Fitzpatrick, Cella, Harper & Scinto

(57) ABSTRACT

An image forming apparatus includes a rotatable image bearing member; a developing device, including a developer carrying member and developing bias application means for applying a developing bias for developing a developer image; a rotatable intermediary transfer member; a primary transfer member for forming a primary transfer nip and for transferring the developer image from the image bearing member onto the intermediary transfer member; a secondary transfer member for secondary-transferring the developer image from the intermediary transfer member onto a recording material; wherein an area of the image bearing member includes a first area at least containing an area located in primary transfer nip at a time when a speed of the intermediary transfer member is temporarily decreased and includes a second area located in the primary transfer nip when there is no temporary change in speed; and a control device for controlling a developing bias.

16 Claims, 18 Drawing Sheets

(a)

(b)

(a)

(b)

(a)

(b)

(a)

(b)

IMAGE FORMING APPARATUS

FIELD OF THE INVENTION AND RELATED ART

The present invention relates to an image forming apparatus for forming an image on a recording material or medium.

In recent years, the image forming apparatus such as a laser printer or a copying machine is required that it has functions of increasing a speed for improving productivity and of improving image qualities and the like functions and that it can support the recording material (hereinafter referred to as a sheet) of various types. For example, in a color laser printer, a method in which an intermediary transfer belt (intermediary transfer member) capable of carrying a plurality of developer images has been employed. In this method, the number of sheets subjected to image formation per unit time can be increased and a constitution thereof is suitable for improvement in image quality when a color image is formed. In the constitution of the method, a developer image is formed on a photosensitive drum as an image bearing member by using a developer (e.g., toner), primary-transferred onto the intermediary transfer belt, and then secondary-transferred from the intermediary transfer belt onto the sheet. In such a constitution, the intermediary transfer belt and a transfer member for transferring the developer image from the belt onto the sheet press-contact each other at a predetermined pressure to form a press-contact portion (hereinafter referred to as a secondary transfer nip). For that reason, when a leading end of the sheet enters the secondary transfer nip or when a trailing end of the sheet comes out of the secondary transfer nip, load variation occurs with respect to the intermediary transfer belt in some cases. In the case where the load variation occurs, a drive transmission member such as gears is deformed to cause large speed variation with respect to the intermediary transfer belt in some cases. When the large speed variation occurs with respect to the intermediary transfer belt, density variation of the developer image occurs at the time when the developer image is transferred from the photosensitive drum onto the intermediary transfer belt (primary transfer) to result in image defect. This image defect is referred to as impact-caused unevenness. The reason why the impact-caused unevenness is liable to occur in the above-described constitution in recent years will be described. First, based on media flexibility characterizing the constitution using the intermediary transfer belt, sheets having various thicknesses are used relatively easily. Particularly, with respect to a thick sheet, when the leading end of the sheet enters the secondary transfer nip or when the trailing end of the sheet comes out of the secondary transfer nip, a tangential force applied from the sheet onto the intermediary transfer belt in the secondary transfer is larger than that in the case of using a thin sheet (thin paper). As a result, the load variation is increased, so that the impact-caused unevenness is liable to occur. Secondly, also with respect to wide variety of sheets, a secondary transfer pressure is increased so as to ensure a sufficient transfer property. Particularly, with respect to a sheet having an uneven surface configuration, there is a tendency that a transfer efficiency is liable to be lowered at a recessed portion. In this case, in order to increase the transfer efficiency by uniformizing the uneven surface configuration of the sheet, a method in which the transfer pressure is increased can be employed. Also in this case, the tangential force applied from the sheet onto the intermediary transfer belt is increased to result in the large load variation, so that the impact-caused unevenness is liable to occur. Thirdly, in order to prolong a lifetime, in the case of monochromatic printing, a monochromatic mode can be employed. The monochromatic mode refers to a mode in which one of image forming portions (e.g., a black image forming portion) is caused to function a method in which the intermediary transfer member capable of carrying the plurality of developer images is used, in contrast to a full-color mode in which all the image forming portions are caused to function. The purposes of the full-color mode are that the lifetime of the photosensitive drum at each of the image forming portions is increased and that an amount of toner consumption is reduced. In the monochromatic mode using only the black image forming portion, the photosensitive drums of the image forming portions which are not caused to function are not brought into contact with the intermediary transfer belt by separation, so that abrasion of the surfaces of the photosensitive drums can be prevented. Further, in the case where a blade is used for cleaning the photosensitive drum, rotation of the photosensitive drum is stopped, so that it is possible to prevent the abrasion by the blade. Compared with the full-color mode, in the monochromatic mode, the number of the photosensitive drum(s) contacting the intermediary transfer belt is small, so that the number of constraint points is also small, thus leading to a small nipping force. Therefore, in the monochromatic mode in which the nipping force is small, e.g., in the case of using the thin paper, even small load variation leads to the speed variation. Further, in the case of a rotary-type developing device, a constitution in which a cleaning roller (or a cleaning blade) for cleaning the intermediary transfer belt or a secondary transfer roller is moved toward and away from the intermediary transfer belt is employed. In this case, a load exerted on the intermediary transfer belt is varied at the moment when the cleaning blade (cleaning roller) or the secondary transfer roller contacts or is separated from the intermediary transfer belt. For that reason, in some cases, the intermediary transfer belt causes temporary speed variation.

In order to prevent the impact-caused unevenness described above, methods of suppressing the speed variation of the intermediary transfer member have been disclosed. Japanese Laid-Open Patent Application (JP-A) 2007-147758 proposes, a constitution in which a transfer material is caused to enter the nip with predetermined acceleration in order to suppress the impact-caused unevenness occurring at the time when the leading end of the transfer material enters the nip, thereby to suppress the speed variation of the intermediary transfer member. JP-A 2007-328094 proposes a constitution in which a lubricating and smoothing member is, separately from the cleaning blade, caused to press-contact an image forming area to provide, to the intermediary transfer belt, a dynamic frictional resistance equal to or more than that from the cleaning blade to the intermediary transfer belt. JP-A 2004-302308 proposes a constitution in which image writing correction is made by an exposure means with respect to a scanning line for which the speed variation of the intermediary transfer belt occurs.

However, the constitution proposed in JP-A 2007-147758 is not applicable to the impact-caused unevenness occurring due to the load variation when the trailing end of paper comes out of the secondary transfer nip and is not applicable to the impact-caused unevenness occurring due to a factor other than conveyance of paper, so that an applicable condition is limited. The constitution proposed in JP-A 2007-328094 is complicated and newly requires a plurality of additional parts, thus leading to an increase in cost. Further, the constitution causes an increase in torque for driving the intermediary transfer belt. As described above, when the speed variation of the intermediary transfer member is intended to be suppressed, the above-described conventional constitutions are accompanied with problems such that the constitutions are not applicable to some impact-caused unevenness depending on a generating mechanism, that an effect of the constitution is limited depending on the type of paper (sheet) or a print mode, and that the constitutions lead to the increase in cost. In the constitution proposed in JP-A 2004-302308, an image forming means is subjected to correction control by thinning of scanning lines, blank shot, double shot, and the like by using an exposure means. For that reason, there is a possibility that the correction control interferes with dithering to generate moire (interference fringe). The dithering is generally designed so as not to interfere with banding or the like, so that when the correction control as described above is made, design latitude is further decreased.

SUMMARY OF THE INVENTION

A principal object of the present invention is to provide a high-quality image forming apparatus capable of stably remedying image defect, by a simple constitution with no disadvantage, caused due to image defect generated by temporary speed variation of an intermediary transfer member resulting from load variation of the intermediary transfer member. Specifically, the present invention is different from the above-described conventional constitutions in which the speed variation itself of the intermediary transfer member is suppressed, and suppresses density variation generated by the speed variation.

Therefore, a specific object of the present invention is to provide an image forming apparatus capable of stably achieving, compared with the above-described conventional constitutions, an effect irrespective of a generating mechanism and a condition such as the type of paper or a print mode and capable of improving an image quality with less disadvantage and less increase in cost.

Another specific object of the present invention is to provide an image forming apparatus capable of improving the image quality with no disadvantage even in the case where speed variation of the intermediary transfer member is particularly large.

A further specific object of the present invention is to provide an image forming apparatus having an advantage such that there is no need to consider a disadvantage of an occurrence of moire due to interference between dithering and writing correction by light exposure.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS (Embodiment 1)

(1) Image Forming Apparatus

Figure 1:
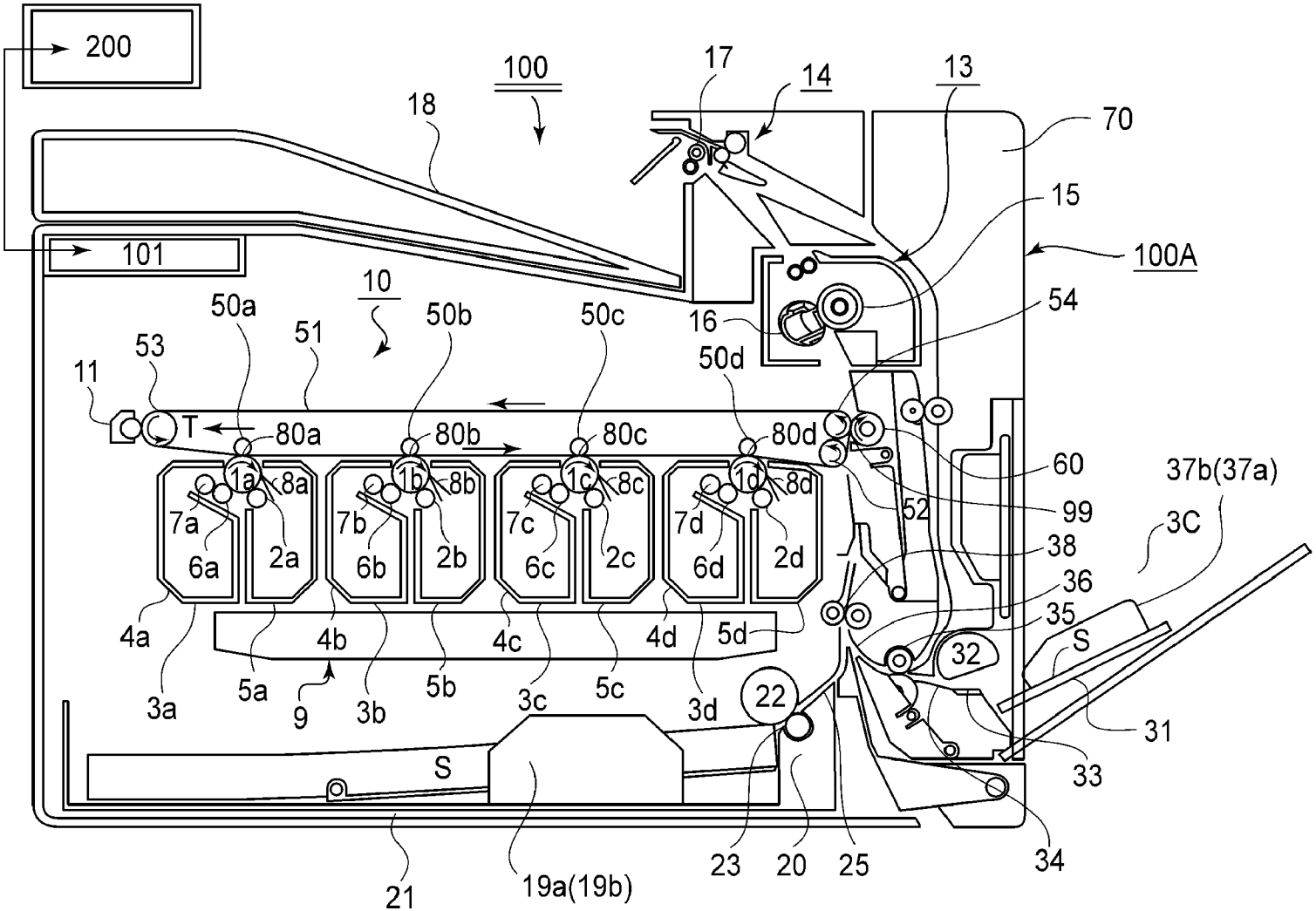
FIG. 1 is a schematic illustration of an image forming apparatus in Embodiment 1.

FIG. 1 is a schematic illustration of an embodiment of the image forming apparatus according to the present invention. An image forming apparatus 100 is a color printer of an electrophotographic type. The image forming apparatus 100 effect color image formation or monochromatic image formation on a sheet-like recording material as a recording medium (hereinafter referred to as a "sheet") on the basis of an electrical image signal input from a host device 200 into a control portion (a control means or a control circuit control portion) 101. The host device 200 is, e.g., a personal computer, an image reader, or the like. The control portion 101 includes a CPU (computing portion), an ROM (storing means), and the like and performs various electrical information transfer between itself and the host device 200 or an operating portion (not shown) of the image forming apparatus 100. Further, control portion 101 effects centralized control of an image forming operation of the image forming apparatus 100 in accordance with a predetermined control program or a predetermined reference table. The control portion 101 controls a charging bias, a developing bias, and a transfer bias which are described later. The image forming apparatus 100 includes four process cartridges 3 (3*a*, 3*b*, 3*c* and 3*d*) detachably mountable to an apparatus main assembly 100A. The respective cartridges 3 are arranged side by side from a left side to a right side in FIG. 1 with a predetermined interval (tandem arrangement). The respective cartridges 3 have the same structure but are different in that they are used to form images (developer images) of toners of yellow (Y), magenta (M), cyan (C) and black (Bk). Each cartridge 3 is constituted by a developing unit 4 (4*a*-4*d*) and a cleaner unit 5 (5*a*-5*d*). The developing unit 4 includes a developing roller 6 (6*a*-6*d*) as a rotatable developer carrying member constituting a developing portion with respect to a photosensitive drum 1 (1*a*-1*d*) as an image bearing member. The developing roller 6 and a power source 6*d*V (developing bias application means) for applying the developing bias to the developing roller 6 constitute a developing device. The developing unit 4 further includes a developer applying roller 7 (7*a*-7*d*) as a developer feeding member for feeding the developer in contact or proximity with the developing roller 6 and includes a toner container as a developer accommodating portion. The cleaner unit 5 includes the photosensitive drum 1 (1*a*-1*d*) as the rotatable image bearing member, a charging roller 2 (2*a*-2*d*) as a charging member, a drum cleaning blade 8 (8*a*-8*d*), and a residual toner container. The charging roller 2 and a power source 2*d*V (charging bias application means) for applying the charging bias to the charging roller 2 constitute a charging device. The photosensitive drums 1*a*, 1*b*, 1*c* and 1*d* constitute a plurality of image bearing members. Vertically below the cartridges 3, a scanner unit 9 as an exposure means is disposed to expose the drum 1 to light on the basis of the image signal. The drum 1 is rotationally driven in an indicated clockwise direction at a predetermined speed and is electrically charged to a predetermined negative potential in this embodiment by the charging roller 2. Thereafter, an electrostatic latent image is formed on each drum 1 by the exposure by using the scanner unit 9. An exposed portion is an image portion, and a non-exposed portion is a non-image portion. The electrostatic latent image is subjected to reverse development in this embodiment, so that the negatively charged toner is deposited on an associated drum, thus forming a toner image of Y, M, C or Bk. In the following description, the toner having the negative polarity as a normal charge polarity thereof will be described. The normal charge polarity of the toner means a charge polarity of the toner used during development of the electrostatic latent image. Vertically above the cartridge 3, an intermediary transfer belt unit 10 is disposed. The unit 10 includes parallel three rollers consisting of a driving roller 52 located on the right side of the cartridge 3*d*, a secondary transfer opposite roller 54 located above the driving roller 52, and a tension roller 53 located on the left side of the cartridge 3*a*. Around the three rollers, a flexible intermediary transfer belt 51 as an intermediary transfer member (hereinafter referred to as a "belt" 51) is stretched. The tension roller 53 applies a tension to the belt 51 in a direction indicated by an arrow T. The belt 51 is circulated and moved in an indicated counterclockwise direction at a predetermined speed corresponding to a rotational speed of the drum 1 by rotational drive of the driving roller 52. Inside the belt 51, primary transfer rollers 50 (50*a*-50*d*) as a primary transfer member are disposed at positions in which the primary transfer rollers 50*a* to 50*d* oppose the photosensitive drums 1*a* to 1*d*, respectively, through the belt 51. Each primary transfer roller 50 and a power source 50*d*V (primary transfer bias application means) for applying a bias to the primary transfer roller 50 constitute a primary transfer device. The primary transfer rollers 50*a*, 50*b*, 50*c* and 50*d* constitute a plurality of photosensitive drum members. Each primary transfer roller 50 brings the belt 51 into contact with the drum 1 to form a primary transfer nip (a primary transfer position; hereinafter referred to as a "T1 nip") 80 (80*a*-80*d*). The primary transfer roller 50 is configured so that a primary transfer bias of a predetermined potential and an opposite polarity (positive in this embodiment) to the charge polarity of the toner is applied from an unshown primary transfer bias application means to the primary transfer roller 50. A secondary transfer roller 60 as a secondary transfer member press-contacts the belt 51 so as to oppose the secondary transfer opposite roller 54. A press-contact portion between the secondary transfer roller 0 and the belt 51 is a secondary transfer nip (a secondary transfer portion; hereinafter referred to as a "T2 nip") 99. The secondary transfer roller 60 is configured so that a secondary transfer bias of a predetermined potential and an opposite polarity (positive in this embodiment) to the charge polarity of the toner by an unshown secondary transfer bias application means to the secondary transfer roller 60. The intermediary transfer member 51 is not limited to that of an endless belt type but may also be that of a rotatable drum type.

An operation for forming a full-color image in a full-color mode as a first mode in which the image is formed by the plurality of image bearing members, i.e., an image forming mode in which all the image forming portions are caused to function is as follows. The drum 1 of each cartridge 3 is rotationally driven in the clockwise direction indicated by the arrow at a predetermined control speed. The belt 51 is rotationally driven in the counterclockwise direction indicated by the arrows (in the same direction as the rotational direction of the drum 1) at a speed corresponding to the speed of the drum 1. The scanner unit 9 is also driven. In synchronism with this drive, in each cartridge 3, the charging roller 2 electrically charges uniformly the surface of the drum 1 to a predetermined potential with predetermined timing. The scanner unit 9 subjects the surface of each drum 1 to scanning example to laser light modulated depending on image information (image signal) for each color. As a result, an electrostatic latent image is formed on the surface of each drum 1 with predetermined control timing correspondingly to the image signal for associated color. The thus formed electrostatic latent image is developed into a toner image by the developing roller 6 of the developing unit 3 for the associated color. To each primary transfer roller 50, a predetermined primary transfer bias is applied with predetermined control timing. By the electrophotographic image forming process operation as described above, on the drum 1*a* of the cartridge 3*a*, the toner image of Y corresponding to a yellow component of a full-color image is formed. The toner image is primary-transferred onto the belt 51 in the T1 nip by the primary transfer bias and a primary transfer pressure. On the drum 1*b* of the cartridge 3*b*, the toner image of M corresponding to a magenta component of the full-color image is formed. The toner image is superposedly primary-transferred onto the toner image of Y, which has already been transferred on the belt 51, in the T1 nip 80*b* by the primary transfer bias and the primary transfer pressure. On the drum 1*c* of the cartridge 3*c*, the toner image of C corresponding to a cyan component of the full-color image is formed. The toner image is superposedly primary-transferred onto the toner images of Y and M, which have already been transferred on the belt 51, in the T1 n 80*c* by the primary transfer bias and the primary transfer pressure. On the drum 1*d* of the cartridge 3*d*, the toner image of Bk corresponding to a black component of the full-color image is formed. The toner image is superposedly primary-transferred onto the toner images of Y, M and C, which have already been transferred on the belt 51, in the T1 nip 80*d* by the primary transfer bias and the primary transfer pressure. As a result, unfixed full-color toner images of Y, M, C and Bk are synthetically formed on the belt 51. In each cartridge 3, transfer residual toner remaining on the surface of the drum 1 after the primary transfer of the toner image onto the belt 51 is removed by the cleaning blade 8.

On the other hand, with predetermined control timing, the sheet S as the recording material is fed from a sheet feeding portion. In the image forming apparatus 100 in this embodiment, two (first and second) sheet feeding devices (portions) are used. The first sheet feeding portion is a main assembly sheet feeding portion 20 provided inside the apparatus main assembly 100A. The second sheet feeding portion is a manual sheet feeding portion 30 provided on a side surface of the apparatus main assembly 100A. With respect to the main assembly sheet feeding portion 20, a sheet feeding cassette 21 is inserted into a positioning portion inside the apparatus main assembly 100A. In this embodiment, the cassette 21 is abutted against a front-side plate (not shown) provided on a front side of the image forming apparatus 100 (FIG. 1). In the cassette 21 shown in FIG. 1, positioning of the sheet S with respect to a direction perpendicular to a sheet feeding direction (i.e., a sheet widthwise direction) is performed by a front-side side regulating plate 19*a* and rear-side side regulating plate 19*b* which are movably provided with respect to the cassette 21 so as to fit a size of the sheet S. By these side plates 19*a* and 19*b*, the sheets S are stacked in a state in which they are positioned with an open upper surface, and are positioned with respect to the apparatus main assembly 100A with accuracy. The main assembly sheet feeding portion 20 includes a sheet feeding roller 22 for feeding the sheets S from the sheet feeding cassette 21 for accommodating the sheets S and includes a separation roller 23 as a separating means. The sheets S accommodated in the cassette 21 are pressed against the sheet feeding roller 22 and are separated and fed one by one by the separation roller 23. The separated sheet S is conveyed to a registration roller pair 38, as a conveying portion for conveying the sheet S to the T2 nip 99, through a main assembly sheet conveying path 25. The manual sheet feeding portion 30 includes an intermediate plate 31 for stacking the sheets S, a sheet feeding roller 32 for feeding the uppermost sheet S on the intermediate plate 31, and a separation pad 33 as the separating means. In FIG. 1, the manual sheet feeding portion 30 further includes a front-side side plate 37*a* and a rear-side side plate 37*b* which are configured to regulate the position of the sheets S with respect to the direction perpendicular to the sheet conveying direction (i.e., with respect to the sheet widthwise direction). The intermediate plate 31 is raised and the sheets S stacked on the intermediate plate 31 are pressed against the sheet feeding roller 32, so that the sheets S are separated and fed one by one by the separation pad 33. Then, the separated sheet S is conveyed to a sheet refeeding roller pair 35 through a manual sheet feeding path 34 and passes through a sheet refeeding path 36, thus being conveyed to the registration roller pair 38. As described above, on an upstream side of the registration roller pair 38, the two conveying paths for the main assembly sheet feeding portion 20 and the manual sheet feeding portion 30 join. By the registration roller pair 38, the sheet S is conveyed to the T2 nip 99 with predetermined control timing. To the secondary transfer roller 60, a predetermined secondary transfer bias is applied with predetermined control timing. As a result, in the process in which the sheet S is nip-conveyed in the T2 nip 99, the four color toner images superposed on the belt 51 are collectively secondary-transferred onto the surface of the sheet S by the secondary transfer bias and a secondary transfer pressure. The sheet S coming out of the T2 nip 99 is separated from the surface of the belt 51 and then is guided into a fixing device 13 as an image fixing means. The fixing device 13 includes a fixing member 16 as a heating member and an elastic pressing roller 15 as a pressing member. The fixing member 16 and the pressing roller 15 press-contact each other to form a fixing nip as a heating nip. The sheet S carrying thereon the unfixed toner image is conveyed into the fixing nip and is nip—conveyed in the fixing nip, so that the unfixed toner image is heated and pressed. As a result, melt-mixing and fixing of the respective color toner images on the sheet S are performed. Then, the sheet S comes out of the fixing device 13 and is discharged on a discharging tray 18 as a full-color image formation product by a sheet discharging roller 17 disposed in a sheet discharging unit 14. Further, secondary transfer residual toner remaining on the surface of the belt 51 after the sheet separation is removed by a belt cleaning device 11 and the removed toner passes through a residual toner conveying path (not shown), thus being collected in a residual toner collecting container (not shown) disposed at a rear surface portion of the apparatus.

Figure 2B:
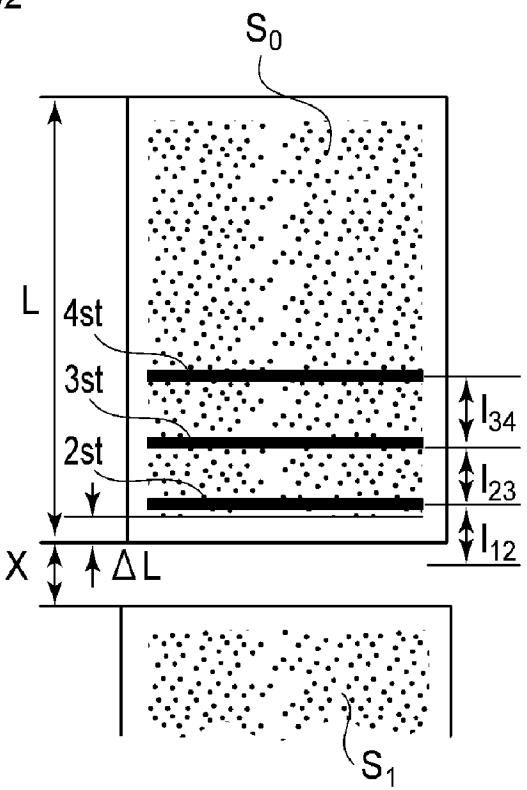
FIG. 2B is a schematic view showing a generation position of impact-caused unevenness on an image when a leading end of a sheet enters a nip T2 in the full-color mode.
Figure 2A:
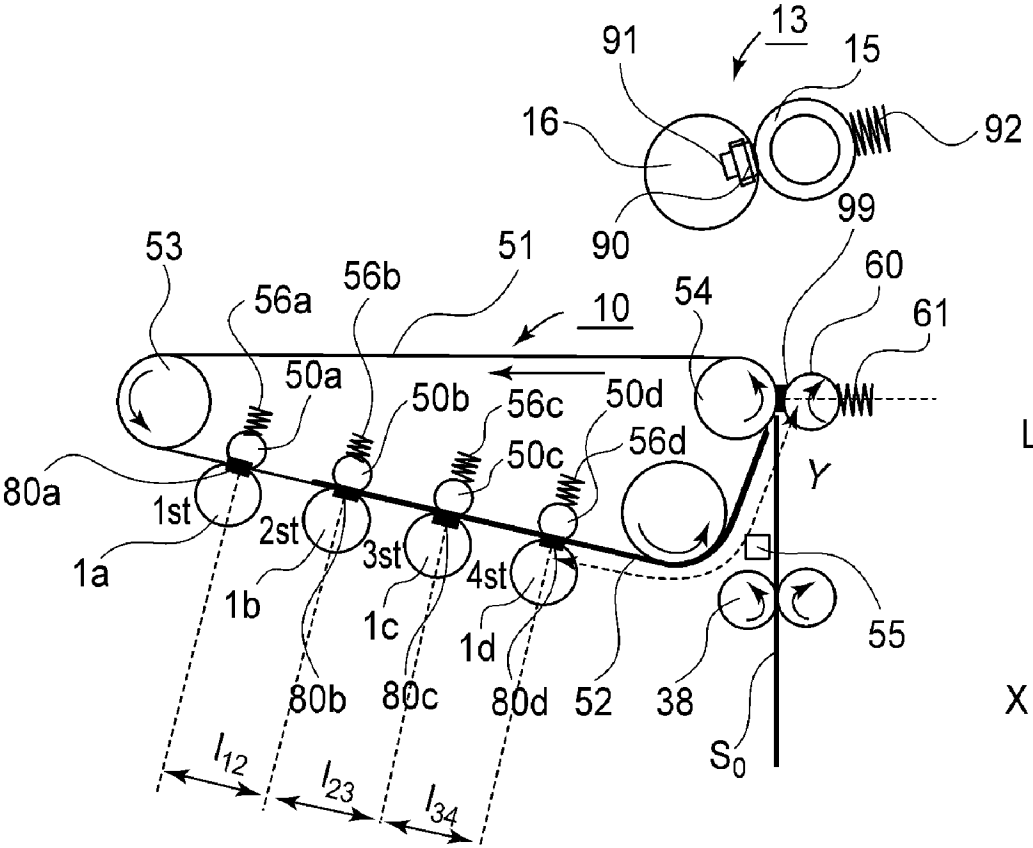
FIG. 2A is a schematic view showing an intermediary transfer portion (full-color mode)
Figure 2D:
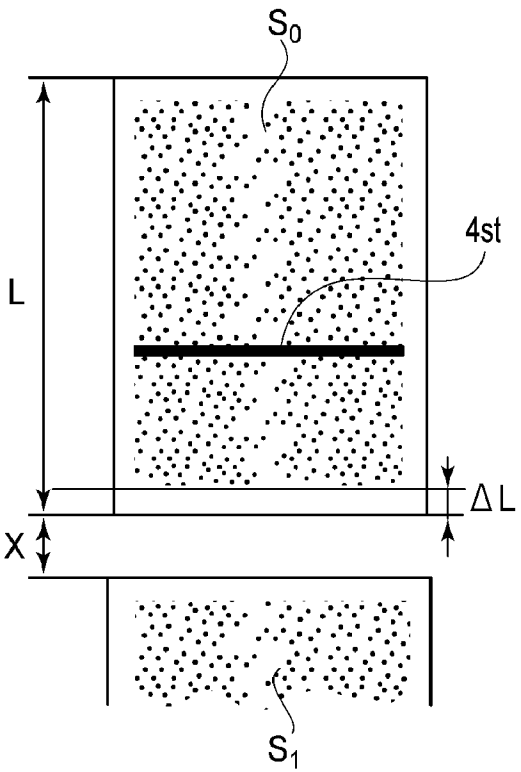
FIG. 2D is a schematic view showing the generation position of the impact-caused unevenness on the image when the leading end of the sheet enters the nip T2 in the monochromatic mode.
Figure 2C:
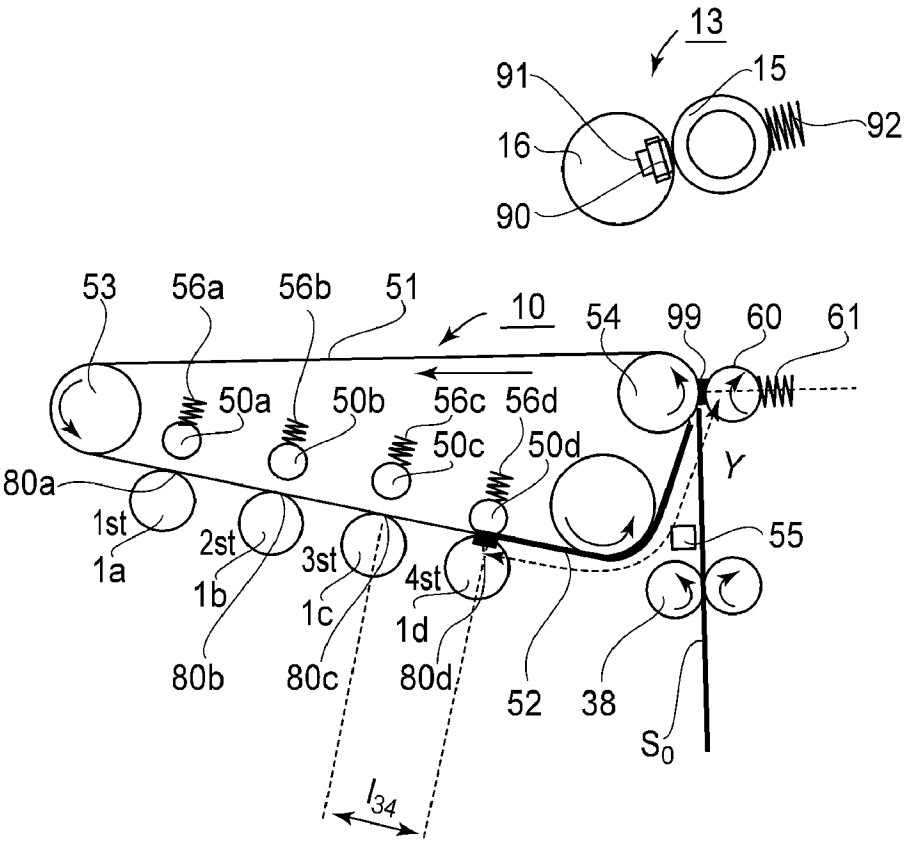
FIG. 2C is a schematic view showing the intermediary transfer portion (monochromatic mode)

The image forming apparatus can also execute a monochromatic mode (a second mode in which image formation is effected in a state in which a part of the plurality of primary transfer member or the plurality of image bearing members is separated from the intermediary transfer member, i.e., an image forming mode in which one of the image forming portions is caused to function). For example, in the case of the monochromatic mode in which a black (Bk) image is formed on the recording material, as shown in the illustration of FIG. 2C, the drum 1*d* of the cartridge 3*d* for forming the Bk toner image and a corresponding primary transfer roller 50*d* sandwich and press the belt 51 to form the T1 nip 80*d*. The primary transfer rollers 50*a*, 50*b* and 50*c* corresponding to the drums 1*a*, 1*b* and 1*c* of other cartridges 3*a*, 3*b* and 3*c* are kept in a separated state from the belt 51. That is, the T1 nips 80*a*, 80*b* between the belt 51 and the drums 1*a*, 1*b* and 1*c* of other cartridges 3*a*, 3*b* and 3*c* are released. Alternatively, the drums 1*a*, 1*b* and 1*c* of other cartridges 3*a*, 3*b* and 3*c* are separated from the belt 51 to release the T1 nips 80*a*, 80*b* and 80*c*. Then, in this state, the belt 51 is rotationally driven to execute the image formation only by the cartridge 3*d*, so that the black image is formed on the recording material S. The control portion 101 judges whether the image forming mode is the monochromatic mode or the full-color mode on the basis of the image signal. In the case where the control portion 101 judges that the mode is the monochromatic mode, the control portion 101 controls a cam 402 (primary transfer roller contact-and-separation means), thus controlling a separating operation of the primary transfer roller.

The primary transfer roller contact-and-separation means will be described.

Figure 17:
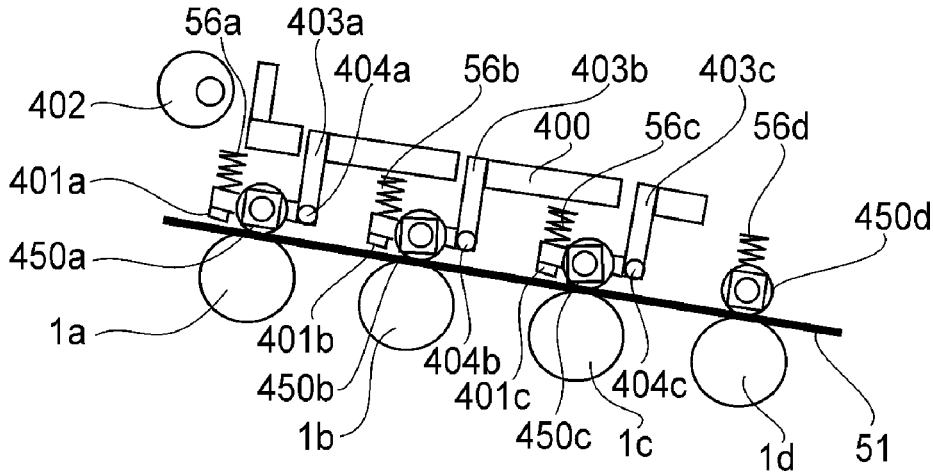
FIGS. 17(*a*) and 17(*b*) are an illustrations of a contact-and-separation mechanism of the primary transfer roller.
Figure 17:
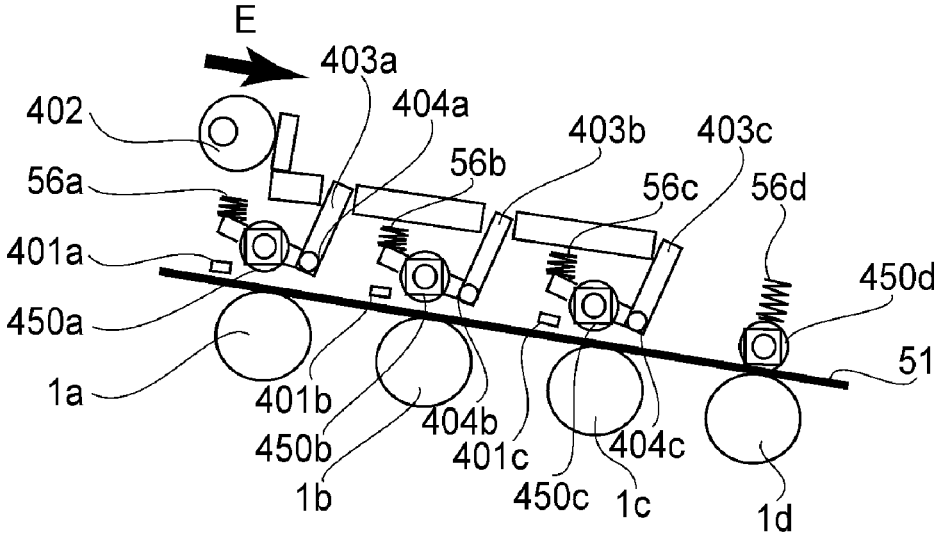

With reference to FIGS. 17(*a*) and 17(*b*), a constitution in which the primary transfer rollers 50*a*, 50*b* and 50*c* are separated from the belt 51 when the control portion 101 judges that the mode is the monochromatic mode will be described as an example.

FIG. 17(*a*) shows a state in the full-color mode. The primary transfer rollers 50*a*, 50*b*, 50*c* and 50*d* are shaft-supported at their both ends by shaft-supporting portions 450*a*, 450*b*, 450*c* and 450*d*. The shaft-supporting portions 450*a*, 450*b* and 450*c* for color stations are supported by L-shaped arms 403*a*, 403*b* and 403*c* having rotation axes 404*a*, 404*b* and 404*c* fixed inside the intermediary transfer belt unit. One end of each L-shaped arm abuts on a stopper 401*a*, 401*b* or 401*c* by an urging force of a compression spring (urging member) 56*a*, 56*b* or 56*c*. Therefore, the primary transfer rollers 50*a*, 50*b* and 50*c* press-contact the drums 1*a*, 1*b* and 1*c* through the belt 51. Further, the other end of each L-shaped arm is held in a state in which it does not contact a lever 400.

FIG. 17(*b*) shows a state in the monochromatic mode.

A driving source (not shown) rotates the cam 402 so that the lever 400 is moved from the position shown in FIG. 17(*a*) in the full-color mode to a position shown in FIG. 17(*b*) by a predetermined distance in a direction indicated by an arrow E, and the rotation of the cam 402 is stopped at the position shown in FIG. 17(*b*).

By the movement of the lever 400 by the predetermined distance, the L-shaped arms 403*a*, 403*b* and 403*c* for the color stations are rotated about the rotation axes 404*a*, 404*b* and 404*c* by a predetermined angle. Thus, the primary transfer rollers 50*a*, 50*b* and 50*c* are separated from the drums 1*a*, 1*b* and 1*c* by a predetermined distance.

(2) Generating Mechanism of Impact-caused Unevenness

In the intermediary transfer belt unit 10, when a leading end of the sheet S enters the T2 nip 99 or when a trailing end of the sheet S comes out of the T2 nip 99, the belt 51 as the intermediary transfer member can cause speed variation. In the case where the speed variation is caused, deformation of a drive (driving force) transmission member such as a gear or the like of the belt unit 10 is caused, so that large speed variation of the belt 51 can be caused. In the case where the large speed variation of the belt 51 occurs, when the toner image is transferred from the drum 1 onto the belt 51 in the T1 nip 80, density variation of the toner image is caused to result in image defect. This image defect is called the impact-caused unevenness. That is, when the leading end of the sheet S enters the T2 nip 99 or when the trailing end of the sheet S comes out of the T2 nip 99, a movement speed of the belt 51 is decreased. For that reason, when the speed of the belt 51 varies, the density of the toner image transferred onto the belt 51 in the T1 nip 80 is increased. For example, even when an image having a uniform density is intended to be formed, an image to be finally output is output with an increased density portion corresponding to the portion at which the speed of the belt 51 varies.

Further, when the trailing end of the sheet S comes out of the T2 nip 99, an increase in speed of the belt 51 can also occur. When the trailing end of the sheet S comes out of the T2 nip 99, a load on the belt 51 is instantaneously decreased, so that the belt 15 is moved fast correspondingly to jerky of the drive transmission member such as the gear. When the speed of the belt 51 is increased, the density of the toner image transferred onto the belt 51 in the T1 nip 80 is decreased.

The generating mechanism of the impact-caused unevenness will be described more specifically. FIG. 2A is a schematic view showing a state of the belt unit 10 in the full-color mode, and FIG. 2B is a schematic view showing a state of the impact-caused unevenness generated in the full-color mode. FIG. 2C is a schematic view showing a state of the belt unit 10 in the monochromatic mode, and FIG. 2D is a schematic view showing a state of the impact-caused unevenness generated in the monochromatic mode. The intermediary transfer belt unit 10 is, as described above, constituted by the driving roller 52, the tension roller 53, the secondary transfer opposite roller 54, the primary transfer rollers 50 (50*a*-50*d*), and the belt 51. The belt 51 is stretched around the driving roller 51, the tension roller 53 and the secondary transfer opposite roller 54. In the full-color mode, as shown in the illustration of FIG. 2A, the primary transfer rollers 50*a* to 50*d* press-contact the belt 51, at a predetermined contact pressure by the compression springs 56*a* to 56*d*, toward the drums 1*a* to 1*d* to form the T1 nips 80*a* to 80*d*. Further, the secondary transfer roller 60 press-contacts the belt 51, at a predetermined contact pressure by the compression spring 61, toward the secondary transfer opposite roller 54 to form the T2 nip 99. The sheet S fed by the first sheet feeding portion 20 or the second sheet feeding portion 30 is temporarily stopped by the registration roller pair 38. The control portion 101 detects, at the time, a thickness of the sheet S by a thickness detection sensor 55. Thereafter, the sheet S is conveyed to the T2 nip 99 by the registration roller pair 38. In the T2 nip 99, the toner images primary-transferred from the drums 1*a* to 1*d* onto the belt 51 are secondary-transferred onto the sheet S. When the sheet S enters the T2 nip 99 by pushing the compression spring 61 correspondingly to its thickness in the process in which the sheet S is conveyed by the registration roller pair 38 and enters the T2 nip 99, a tangential force exerted from the sheet S onto the belt 51 is increased. For that reason, a driving load on the driving roller 52 is increased correspondingly. By this load variation, the drive transmission member such as the gear or the like which drives the driving roller 52 is deformed to delay the drive transmission, so that the speed of the belt 51 is temporarily lowered. By this belt speed lowering, a difference in peripheral speed between the belt 51 and the drum 1 is caused and the toner image contracts during the primary transfer from the drum 1 onto the belt 51 in the primary transfer nip 80, thus causing the density variation such that the density at the portion is higher than that at a portion with no speed variation. The speed variation of the belt 51 can occur when the trailing end of the sheet comes out of the T2 nip 99 or the registration roller pair 38, in addition to the time when the leading end of the sheet enters the T2 nip 99 described above.

Next, a constitution liable to be influenced by the speed decrease or increase (speed variation) of the belt 51 will be described. In the full-color mode shown in FIG. 2A, between the driving roller 52 and the tension roller 53, the drums 1*a*, 1*b*, 1*c* and 1*d* press-contact the belt 51. The belt 51 between the driving roller 52 and the tension roller 53 is kept in a tension state by the driving force of the driving roller 52 and the tension of the tension roller 53 during the drive. At such a position in which the belt 51 is under tension, the constitution is liable to be influenced by the above-described speed variation. Further, a nipping force with respect to the belt 51 in the belt unit 10 in the monochromatic mode shown in FIG. 2C is smaller than that in the belt unit 10 in the full-color mode shown in FIG. 2A. This is because in the monochromatic mode shown in FIG. 2C, the number of the primary transfer rollers press-contacting the belt 51 is decreased to one (i.e., only the primary transfer roller 50*d*). In the monochromatic mode, compared with the full-color mode, the constitution is slidable to be influenced by the speed variation of the belt 51. Further, in order to transfer the toner image onto an uneven sheet uniformly, a nip pressure in the T2 nip 99 is set at a higher level in some cases. In these cases, the tangential force exerted from the sheet S onto the belt 51 is higher than that in the case where the nip pressure in the T2 nip 99 is set at a lower level, so that the load variation is increased and thus the speed variation is liable to occur.

(3) Means for Suppressing Impact-caused Unevenness

In this embodiment, a constitution of a means for suppressing the impact-caused unevenness is not configured so that the speed variation, of the belt 51 as the intermediary transfer member, generated when the sheet S enters the T2 nip 99 or comes out of the T2 nip 99 is suppressed as in the conventional constitutions. In this embodiment, as the constitution of the means for suppressing the impact-caused unevenness, resulting toner image density variation is suppressed. As a result, compared with the conventional constitutions, it is possible to provide a high-quality image forming apparatus capable of stably achieving an effect, irrespective of the type of paper or the print mode, with less disadvantage and less increase in cost. Specifically, when the temporary speed variation of the belt 51 occurs, an amount (per unit area) of the toner in an area (a first area or a third area) at least including a drum area located in the primary transfer nip is changed compared with a drum area (a second area) in which the temporary speed variation of the drum 51 does not occur. Of areas of the drum on which the latent image for image formation on the recording material is to be formed, an area in which the belt speed is temporarily decreased is referred to as the first area and an area in which the belt speed is temporarily increased is referred to as the third area.

In the case where the speed of the belt 51 is temporarily decreased, the toner amount in the first area is made smaller than that in the second area. Specifically, a developing bias is controlled so that a potential difference between an image portion potential of the latent image and a developing bias potential when the latent image in the first area is developed is smaller than a potential difference between the image portion potential of the latent image and a developing bias potential when the latent image in the second area is developed.

On the other hand, in the case where the speed of the belt 51 is temporarily increased, the toner amount in the third area is made smaller than that in the second area. Specifically, a developing bias is controlled so that a potential difference between an image portion potential of the latent image and a developing bias potential when the latent image in the third area is developed is larger than a potential difference between the image portion potential of the latent image and a developing bias potential when the latent image in the second area is developed.

Herein, the "temporary speed variation" does not include a one rotation component or one tooth component of the drive transmission member such as the gear or the like for driving the belt 51.

As described above, the toner amount on the belt 51 is controlled so that the toner amount at a position in which the movement speed of the belt 51 is temporarily changed is equal to the toner amount at a position in which the movement speed of the belt 51 is not changed. For example, the case where image information on a halftone image such that the toner is placed on the entire surface of the sheet at a density level 10 is provided will be described. In the first area including the area in which the speed of the belt 51 is temporarily decreased, even when the image information for placing the toner on the sheet at the density level 10 is provided, the toner amount is controlled at a density level 5 on the drum 1. In the way, even when density information of original image information is the same, the toner amount is changed on the drum 1 in the area in which the speed variation of the belt 51 occurs.

The control of the toner amount in this embodiment will be described specifically.

With timing when the leading end of the sheet S enters the T2 nip 99 or when the trailing end of the sheet S comes out of the T2 nip 99, the impact-caused unevenness (density variation) occurs in the T1 nip 80. Therefore, a position in which the density variation occurs can be predicted by performing computation by the control portion 101 on the basis of information obtained when a print job is input. The information is a process speed, a size of the sheet to be passed through the T2 nip 99, an interval between adjacent sheets (sheet interval), an arrangement interval between adjacent image forming portions, a distance from the T1 nip 80 to the T2 nip 99, sheet entering timing with respect to the T2 nip 99, timing when the sheet S comes out of the T2 nip 99, or the like. When a sheet $S_0$ and a subsequent sheet $S_1$ enters the T2 nip 99 during continuous printing on the two sheets, the impact-caused unevenness occurs with respect to the toner image transferred from the belt 51 onto the sheet $S_0$ itself which has entered the T2 nip 99. On the other hand, the impact-caused unevenness due to the sheet passing through the T2 nip 99 occurs with respect to the toner image transferred from the belt 51 onto the subsequent sheet $S_1$ when the trailing end of the sheet $S_0$ comes out of the T2 nip 99. In this case, the impact-caused unevenness does not occur on the first sheet $S_0$ in the job.

An impact-caused unevenness generating position at the time when the leading end of the sheet S enters the T2 nip 99 or when the trailing end comes out of the T2 nip 99 will be described. On the belt 51 shown in FIG. 2A, the image forming portions are referred to as 1st, 2st, 3st and 4st from the upper-most stream image forming station for performing the primary transfer. A distance from the T1 nip 80*d* at the 4st to the T2 nip 99 on the belt 51 is Y, a distance between the drums at the 1st and the 2st is $l_{12}$, a distance between the drums at the 2st and the 3st is $l_{23}$, and a distance between the drums at the 3st and the 4st is $l_{34}$. Further, a length of the sheet S in a conveyance direction is L, a margin of the sheet S each at a leading end portion and a trailing end portion is ΔL, and a sheet interval between the sheet $S_0$ and the sheet $S_1$ is X. First, the generating position of the impact-caused unevenness at the time when the sheet enters the T2 nip 99 will be described. In the case of the full-color mode shown in FIGS. 2A and 2B, when the primary transfer is performed at all the stations (image forming portions) 1st to 4st, the relationship among the above parameters can be classified into the following cases A) to D) depending on the sheet length L. In either case, it is understood that the generating position can be represented by the parameters determined by only the constitution of the belt 51. Therefore, by obtaining the information on the sheet size (length), it is possible to predict the generating position of the impact-caused unevenness and the station at which the impact-caused unevenness is generated. When the relationship A): $Y<L-\Delta L<Y+l_{34}$ is satisfied, there is a possibility of the occurrence of the impact-caused unevenness at the position spaced from the leading end of the sheet by Y at the 4st. When the relationship B): $Y+l_{34}\leqq L-\Delta L<Y+l_{34}+l_{23}$ is satisfied, there is a possibility of the occurrence of the impact-caused unevenness at the position spaced from the leading end of the sheet by Y at the 4st and at the position of $Y+l_{34}$ at the 3st. When the relationship C): $Y+l_{34}+l_{23} \leqq L-\Delta L < Y+l_{34}+l_{23}+l_{12}$ is satisfied, there is a possibility of the occurrence of the impact-caused unevenness at the position spaced from the leading end of the sheet by Y at the 4st, at the position of $Y+l_{34}$ at the 3st, and at the position of $Y+l_{34}+l_{23}$ at the 2st. When the relationship D): $Y+l_{34}+l_{23}+l_{12} \leqq L-\Delta L$ is satisfied, there is a possibility of the occurrence of the impact-caused unevenness at the position spaced from the leading end of the sheet by Y at the 4st, at the position of $Y+l_{34}+l_{23}$ at the 2st, and at the position of $Y+l_{34}+l_{23}+l_{12}$ at the 1st. Further, in the case of the monochromatic mode using only the 4st as shown in FIGS. 2C and 2D, the impact-caused unevenness occurs only under condition that the relationship A) is satisfied.

Next, the generating position of the impact-caused unevenness at the time when the sheet comes out of the T2 nip 99 will be described.

Figures 3A, 3B:
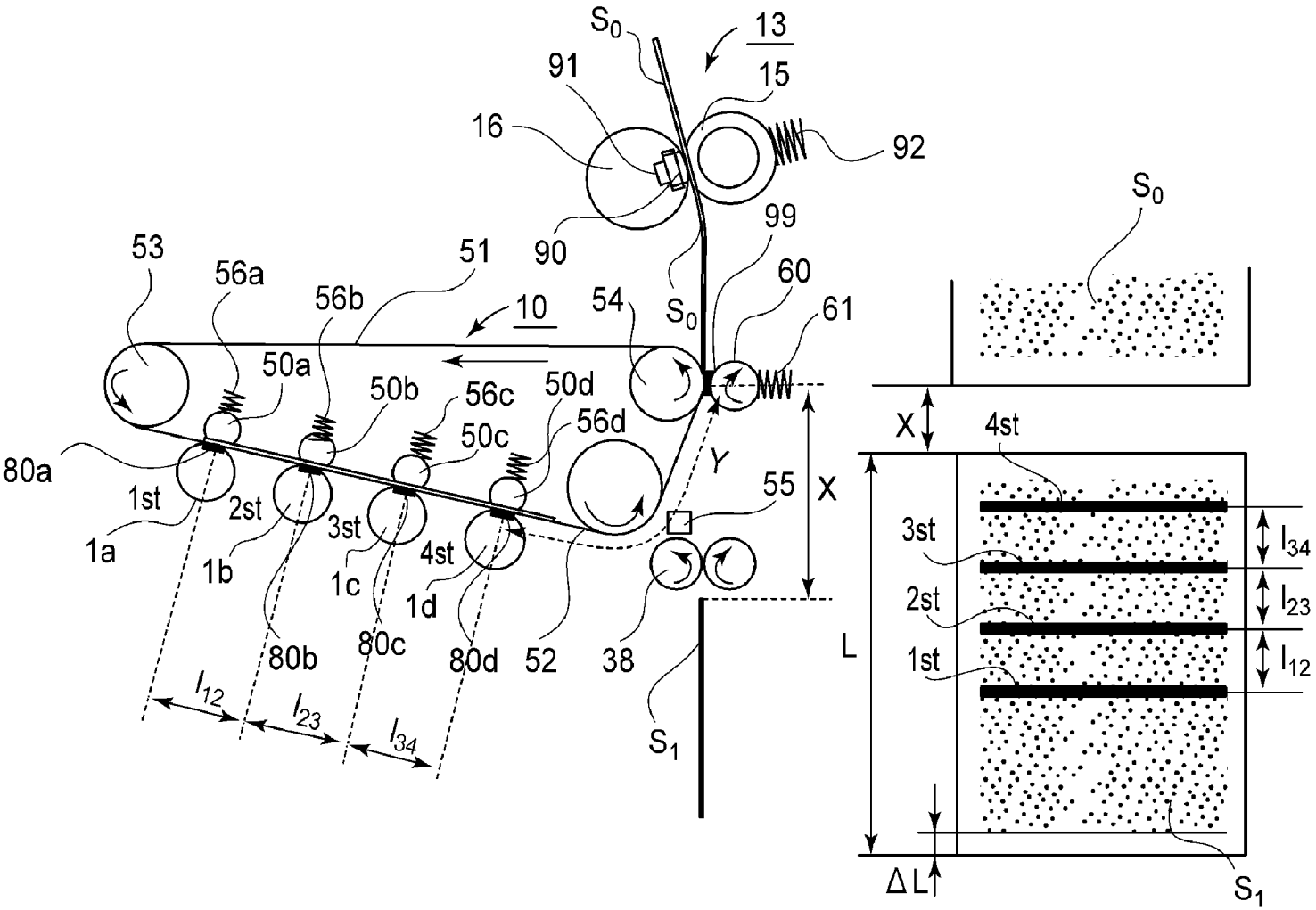
FIG. 3A is a schematic view showing the intermediary transfer portion (full-color mode)
FIG. 3B is a schematic view showing the generation position of the impact-caused unevenness on the image when a trailing end of the sheet comes out of the nip T2 in the full-color mode)
Figure 3D:
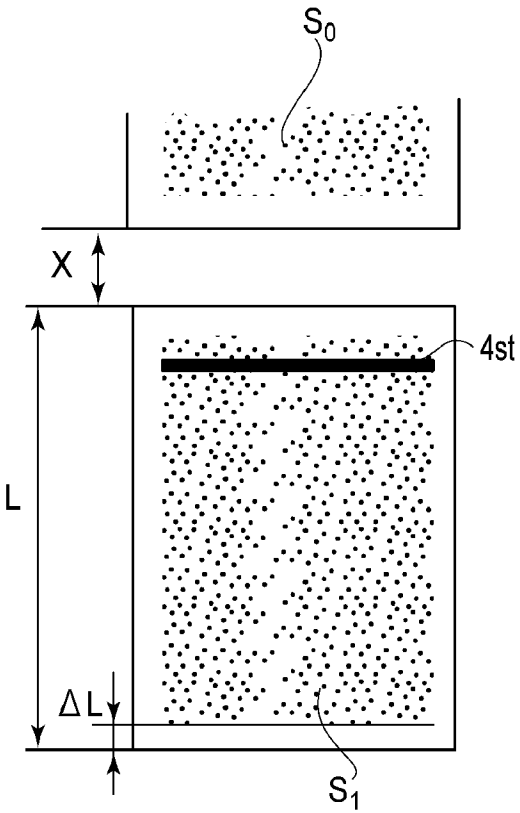
FIG. 3D is a schematic view showing the generation position of the impact-caused unevenness on the image when the trailing end of the sheet comes out of the nip T2 in the monochromatic mode.
Figure 3C:
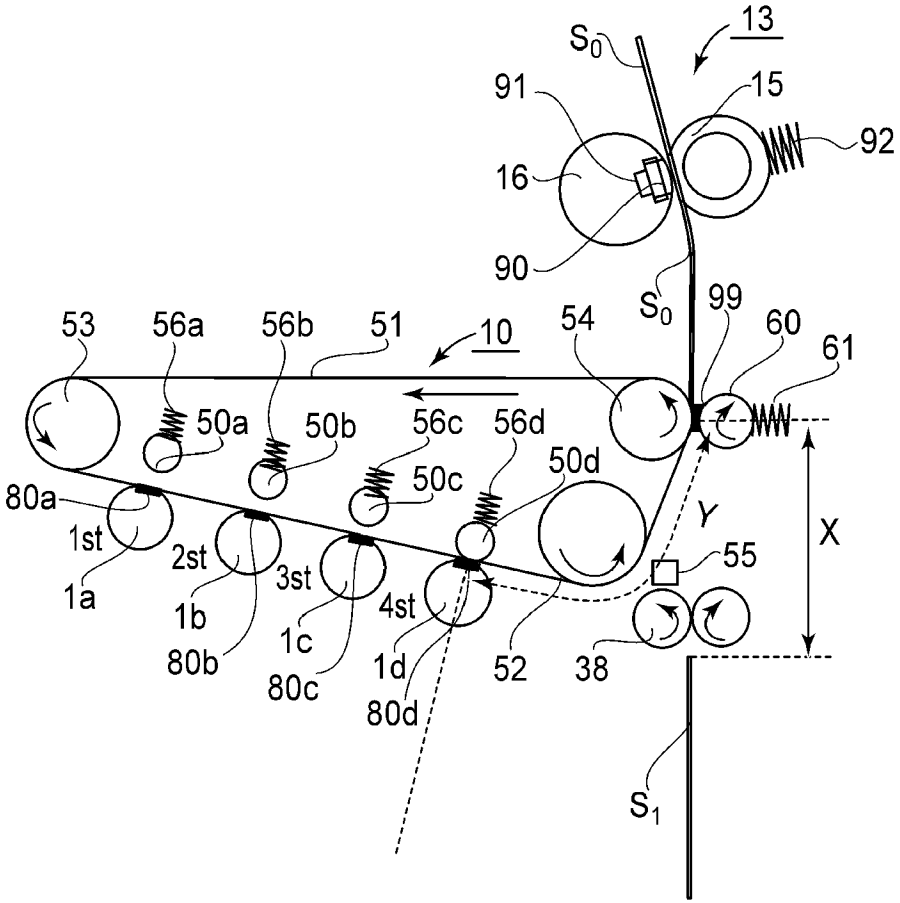
FIG. 3C is a schematic view showing the intermediary transfer portion (monochromatic mode)

Next, the generating position of the impact-caused unevenness at the time when the sheet comes out of the T2 nip 99 will be described. In the case of the full-color mode shown in FIGS. 3A and 3B, when the primary transfer is performed at all the stations (image forming portions) 1st to 4st, the relationship among the above parameters can be classified into the following cases E) to H). The generating position of the impact-caused unevenness at the time when the sheet comes out of the T2 nip 99 changes depending on the sheet interval X. In either case, it is understood that the generating position can be represented by the parameters determined by only the constitution of the belt 51 and by the sheet interval X. Therefore, by obtaining the information on the sheet size (length) and the sheet interval X, it is possible to predict the generating position of the impact-caused unevenness and the station at which the impact-caused unevenness is generated. When the relationship E): $Y-X<L-\Delta L<Y-X+l_{34}$ is satisfied, there is a possibility of the occurrence of the impact-caused unevenness at the position spaced from the leading end of the sheet by (Y−X) at the 4st. When the relationship F): $Y-X+l_{34} \leqq L-\Delta L<Y-X+l_{34}+l_{23}$ is satisfied, there is a possibility of the occurrence of the impact-caused unevenness at the position spaced from the leading end of the sheet by (Y−X) at the 4st and at the position of $Y-X+l_{34}$ at the 3st. When the relationship G): $Y-X+l_{34}+l_{23} \leqq L-\Delta L<Y-X+l_{34}+l_{23}+l_{12}$ is satisfied, there is a possibility of the occurrence of the impact-caused unevenness at the position spaced from the leading end of the sheet by (Y−X) at the 4st, at the position of $Y-X+l_{34}$ at the 3st, and at the position of $Y+l_{34}+l_{23}$ at the 2st. When the relationship H): $Y-X+l_{34}+l_{23}+l_{12} \leqq L-\Delta L$ is satisfied, there is a possibility of the occurrence of the impact-caused unevenness at the position spaced from the leading end of the sheet by (Y−X) at the 4st, at the position of $Y-X+l_{34}+l_{23}$ at the 2st, and at the position of $Y-X+l_{34}+l_{23}+l_{12}$ at the 1st. Further, in the case of the monochromatic mode using only the 4st as shown in FIGS. 3C and 3D, the impact-caused unevenness occurs only under condition that the relationship E) is satisfied.

Next, parameters associated with a magnitude of the impact-caused unevenness (density variation) will be described more specifically.

Figure 4:
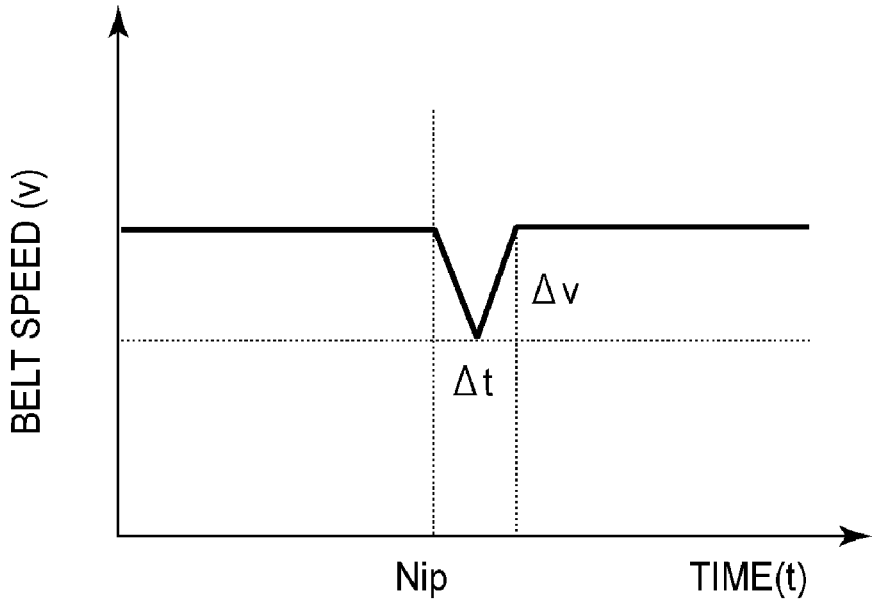
FIG. 4(*a*) is a graph showing a change in speed of an intermediary transfer belt when the leading end of the sheet enters the nip T2, and FIG. 4(*b*) is a graph showing a relationship between a basis weight of the sheet and a speed variation of the intermediary transfer belt when the leading end of the sheet enters the nip T2.
Figure 4:
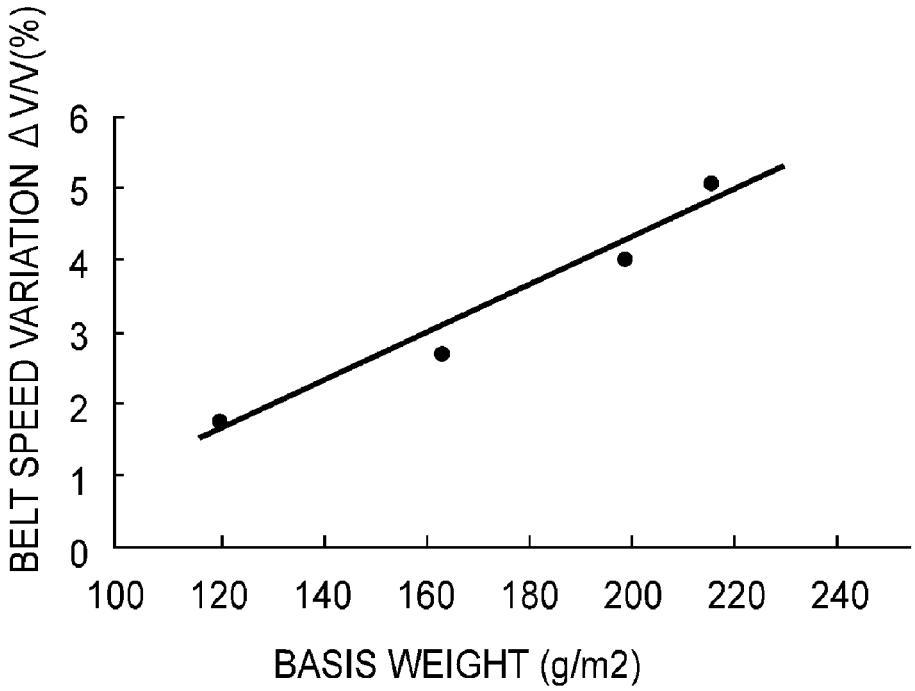

FIG. 4(*a*) is a graph showing a change with time of the speed of the belt 51 when the leading end of the sheet S enters the T2 nip 99. An abscissa represents a time (t) and "Nip" represents timing when the leading end of the sheet enters the T2 nip 99. An ordinate represents the speed of the belt 51. When t=Nip, the speed of the belt 51 is lowered by Δv and a speed lowering duration is Δt. FIG. 4(*b*) is a graph showing a relationship between a basis weight of the sheet S and a speed lowering rate (Δv/v) (%) when the leading end of the sheet enters the T2 nip 99. The basis weight represents a weight of the sheet per unit area (g/m$^2$). In an individual case, the thickness of the sheet is substantially proportional to the basis weight. Therefore, an experiment was conducted easily on the basis of the basis weight. As shown in the graph (FIG. 4(*b*)), with an increasing basis weight (thickness), the speed lowering rate (Δv/v) of the belt 51 is gradually increased, so that these parameters are proportional to each other. Further, as the basis weight (thickness) of the sheet S is increased, load variation is increased, so that an amount of deformation of the driving member is also increased. Therefore, Δt is also increased. As Δv is increased, the peripheral speed between the belt 51 and the drum 1*d* is increased and an amount of contraction of the toner image when the toner image is transferred onto the belt, so that the density is increased. Therefore, a difference (density variation) between the density and the density at a surrounding portion at which there is no speed variation is increased. Further, as Δv is increased, the speed lowering duration of the belt is long. Therefore, a time when the toner image contracts is long, so that a density variation portion on the image is long. That is, the sheet having a large basis weight (thickness) is liable to cause large impact-caused unevenness in a wide range.

Figure 5:
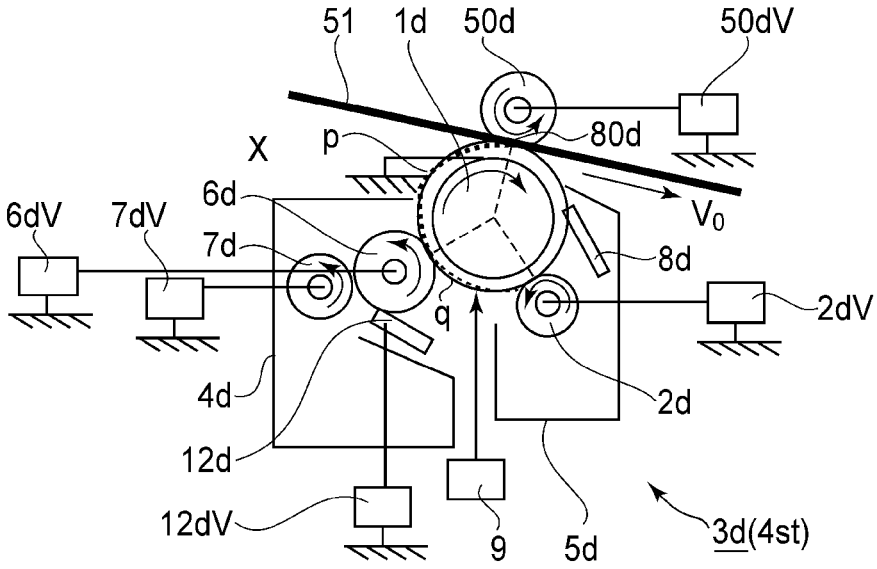
FIG. 5(*a*) is a schematic view showing a (fourth) process cartridge and the intermediary transfer portion, and FIG. 5(*b*) is a block diagram showing signal transmission from a control portion.
Figure 5:
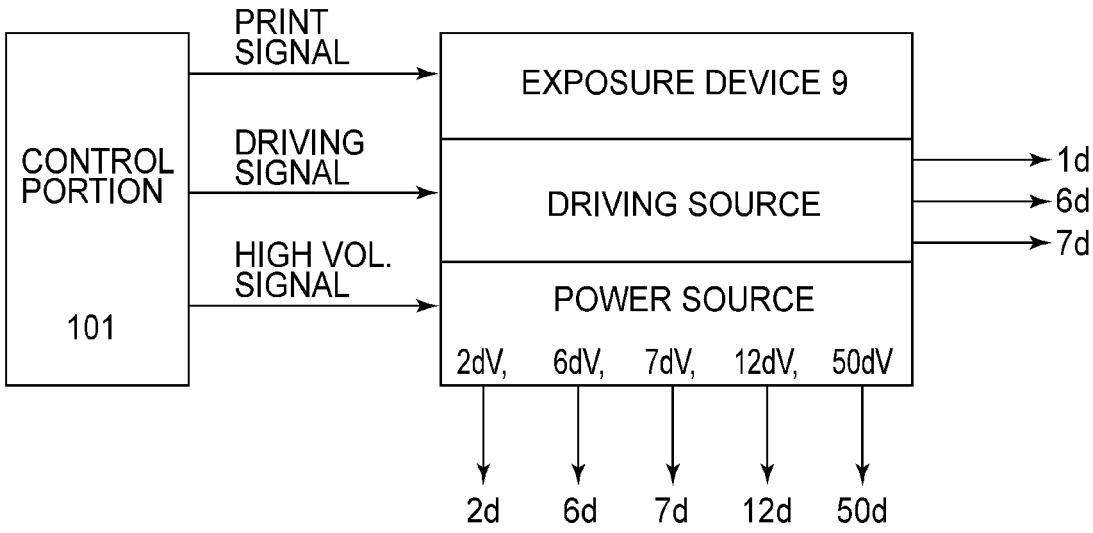
Figure 6:
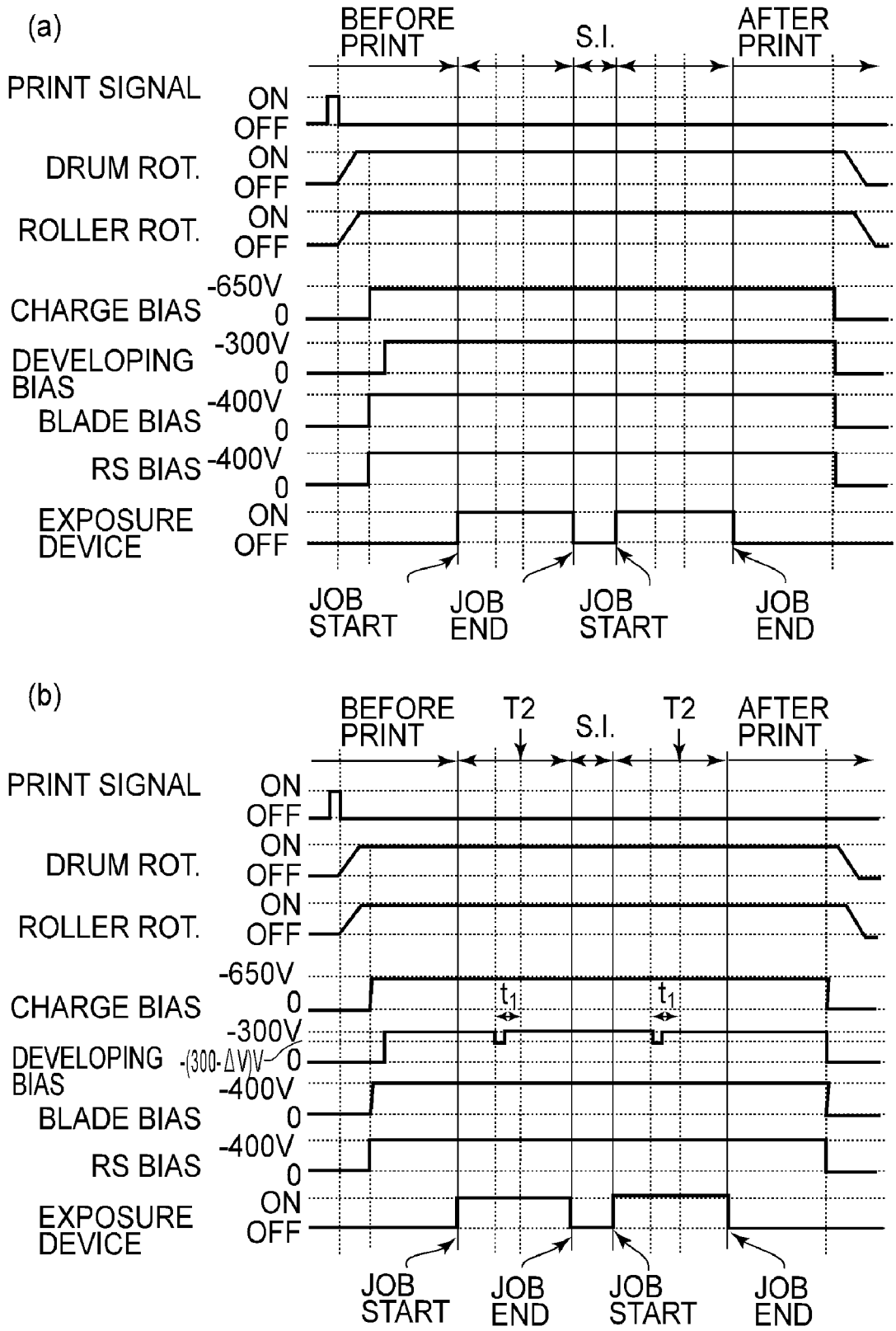
FIG. 6(*a*) is a timing chart of a conventional image forming process, and FIG. 6(*b*) is a timing chart of an image forming process in Embodiment 1.

Next, a method of suppressing the impact-caused unevenness (density variation) as a feature of the present invention will be described. FIG. 5(*a*) is an enlarged schematic view of the 4st station portion representing the four stations 1st to 4st, i.e., the cartridge 3*d* and the portion of the belt 51. The cartridge 3*d* includes the developing unit 4*d* and the cleaner unit 5*d*. The developing unit 4*d* includes the developing roller 6*d*, the developer application roller 7*d* as the developer feeding member for feeding the toner in contact with or in proximity to the developing roller 6*d*, the developing blade 12*d* as a developer layer thickness regulating member, and the toner container. The application roller 7*d* is hereinafter referred to as a remove and supply roller (RS roller). The RS roller 7*d* is rotated counterdirectionally at an opposing portion where the RS roller 7*d* opposes the developing roller 6*d*, so that the RS roller 7*d* has the functions of feeding the toner to the developing roller 6*d* and of collecting the toner remaining on the developing roller 6*d* without being moved to the drum 1*d*. The developing blade 12*d* regulates the toner passing through a contact portion between the developing roller 6*d* and itself to form a thin toner layer on the developing roller 6*d* and also imparts a sufficient triboelectric charge to the toner by friction at the contact portion. On the other hand, the cleaner unit 5*d* includes the drum 1*d*, the charging roller 2*d*, the drum cleaning blade 8*d*, and the cleaner container. The charging roller 2*a* press-contacts the drum 1*d* with a predetermined urging force and is rotated by the rotation of the drum 1*d*, thus electrically charging the drum 1*d* uniformly. The drum cleaning blade 8*d* press-contacts the drum 1*d* with a predetermined pressure and removes the primary transfer residual toner remaining on the drum 1*d* to collect the toner in the cleaner container. FIG. 5(*b*) is a block diagram showing transmission of a signal from the control portion 101 during the image formation. FIG. 6(*a*) shows a timing chart of normal image formation. After the print signal is input, by a driving signal from the control portion 101, the drum 1*d* starts rotation with a lapse of a predetermined rise time. At the same time, the developing roller 6*d* in the developing unit 4*d* also starts rotation. After the rotation of the drum 1*d* reaches steady rotation, by a high-voltage signal from the control portion 101, a voltage (charging bias) is applied to the charging roller 2*d* connected to a power source 2*d*V (developing bias application means). The charging roller 2*d* is rotated by the rotation of the drum 1*d* and electrically charges the drum 1*d* uniformly. In this embodiment, a surface potential of the drum 1*d* is about −650 V. On the other hand, after the rotation of the developing roller 6*d* in the developing unit 4*d* reaches steady rotation, simultaneously with the charging bias application described above, a variation (RS bias or developer feeding bias) is applied to the RS roller 7*d* connected to a power source 7*d*V by a high-voltage signal from the control portion 101. The power source 7*d*V is the developer feeding bias application means. Further, at the same time, to the developing blade 12*d* connected to a power source 12*d*V (developer layer regulating bias application means), a voltage (blade bias or developer layer regulating bias) is applied by a high-voltage signal from the control portion 101. Then, to the developing roller 6*d* connected to a power source 6*d*V (developing bias application means), a voltage (developing bias) is applied by a high-voltage signal from the control portion 101. The developing bias is set at a substantially intermediate value (−300 V) between an exposed portion potential (−200 V) of the drum 1*d* and a non-exposed portion potential (−650 V) of the drum 1*d*. In this embodiment, the reverse development method is employed, so that the exposed portion potential is an image portion potential and the non-exposed portion potential is a non-image portion potential. In the case where normal development is effected, the exposed portion potential is the non-image portion potential and the non-exposed portion potential is the image portion potential. The potentials of the RS bias and the blade bias are required to be set at values higher than the developing bias in terms of an absolute value in order to permit efficient toner feed to the developing roller 6*d*, thus being set at −400 V. Next, depending on the image data (image information), from the upstream station 1st to the downstream station 4st, scanning by the exposure device 9 is performed, so that the electrostatic latent image is formed. Further, the toner formed in the thin layer on the developing roller 6*d* by the developing blade 12*d* has electric charges of the polarity identical to the charge polarity of the drum 1*d* and enters a developing area, which is a contact portion between the drum 1*d* and itself, by the rotation of the developing roller 6*d*, so that the reverse development is effected. Then, to the primary transfer roller 50 connected to a power source 50*d*V (primary transfer bias application means), the primary transfer bias is applied so that the potential of the polarity opposite to the toner charge polarity, so that the belt 51 has the polarity identical to that of the primary transfer roller 50*d*. In this embodiment, as the primary transfer bias, a voltage of +600 V is applied. Therefore, the toner on the drum 1*d* is moved onto the belt 51, thus being subjected to the primary transfer.

Figure 7:
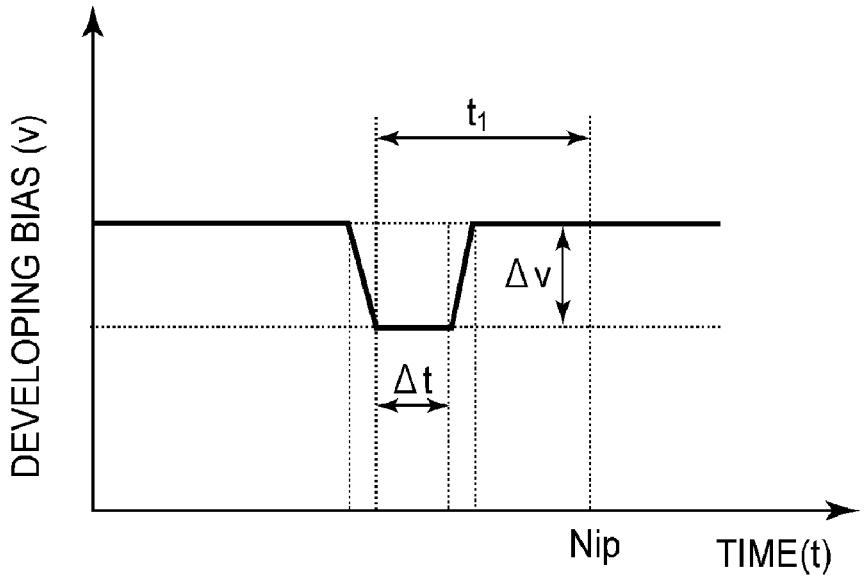
FIG. 7(*a*) is a graph showing developing bias control in Embodiment 1, and FIG. 7(*b*) is a graph showing the case where the developing bias control in Embodiment 1 is performed stepwisely.
Figure 7:
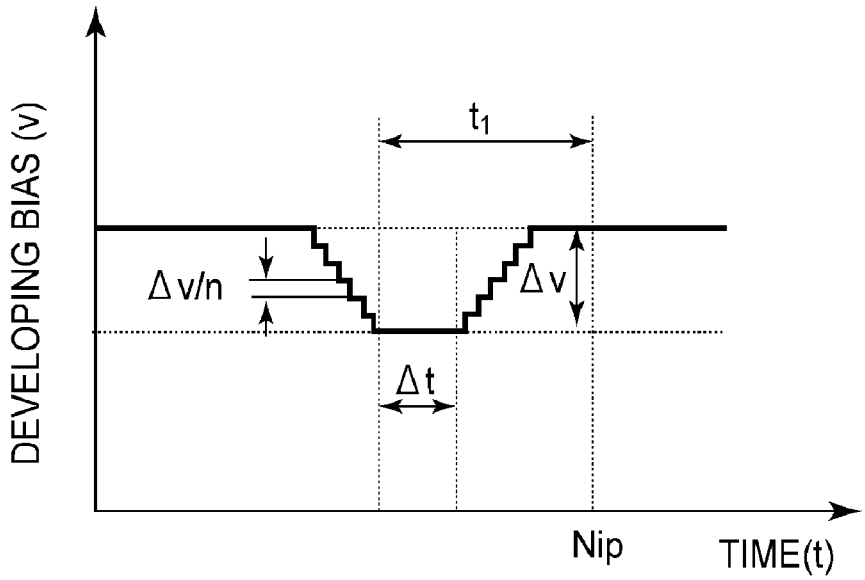

FIG. 6(*b*) is a timing chart of image formation until the primary transfer in this embodiment. As an example, the impact-caused unevenness (density variation) at the time when the leading end of the sheet enters the T2 nip 99 will be described. A portion different from the above-described conventional image forming process is as follows. That is, with timing when the impact-caused unevenness (density variation) generated in the T2 nip 99 due to the entering of the leading end of the sheet in the T2 nip 99, an amount of application of the developing bias for the toner image to be transferred from the drum onto the belt 51 is changed by a predetermined amount for a predetermined duration. As described above, the timing when the speed lowering (impact-caused unevenness) of the belt 51 occurs is predicted. With the timing, the amount of the toner to be transferred from the drum 1*d* onto the belt 51 is decreased by reducing the absolute value of the applied amount of the developing bias. Thus, by reducing the potential difference between the developing bias potential and the image portion potential of the latent image, the toner amount is made lower than the toner amount corresponding to the image data. As a result, when the portion of the toner decreased in amount is transferred onto the belt 51, the toner image contracts by the speed lowering of the belt 51 to be increased in density, so that the density difference between the toner amount-decreased portion and a portion surrounding the toner amount-decreased portion is decreased. Therefore, the impact-caused unevenness (density variation) is less noticeable. A specific control method will be described. First, a graph showing a developing bias control method is illustrated in FIGS. 7(*a*) and 7(*b*). In these figures, the ordinate represents the developing bias (V) and the abscissa represents the time (t). FIG. 7(*a*) shows the case where the developing bias is controlled so as to be lowered by ΔV for a duration Δt of the speed lowering of the belt 51 from the time antecedent, by a time t, to timing (t=Nip) when the leading end of the sheet enters the T2 nip 99. The time t can be represented by $p/V_0$ when p is a distance from the center of the nip (developing position) formed between the drum 1*d* and the developing roller 6*d* shown in FIG. 5(*a*) to the center of the T1 nip 80*d* formed between the drum 1*d* and the belt 51 and when $V_0$ is the conveyance speed of the belt 51. As shown in FIG. 7(*a*), the developing bias may preferably be gradually increased or gradually decreased. The above-described timing when the leading end of the sheet enters the T2 nip or the timing when the trailing end of the sheet comes out of the T2 nip can cause some time deviation with respect to the toner image to be transferred and moved on the belt 51. Therefore, the developing bias change is practically required to be made in a somewhat wide area including the drum area in which the impact-caused unevenness occurs. Therefore, the drum area in which the developing bias is changed includes an area in which the impact-caused unevenness does not occur. In such a case, when the developing bias is abruptly changed, the density change is large in the area in which the impact-caused unevenness does not occur. For that reason, the developing bias is changed so as to be gradually increased or gradually decreased, so that the density variation can be made gentle and abrupt density change can be suppressed.

Here, a fall time and a rise time when the developing bias is changed by ΔV are determined depending on a power source (hardware) constitution. Therefore, in the case where there is a mode in which the conveyance speed of the belt 51 is slow, a length of the toner image to be transferred per unit time is shortened. For that reason, the density change before and after the rise (or the fall) of the voltage when the developing bias is changed becomes abrupt. This is because in the case of the slow conveyance speed of the belt, an amount of movement of the belt in a period from the start of the rise of the developing bias to completion of the rise is decreased. As a result, in some cases, a boundary between a portion at which the developing bias control is effected and a portion at which the developing bias control is not effected is liable to be visible. In these cases, as shown in FIG. 7(*b*), the amount ΔV by which the absolute value of the developing bias is decreased is divided into a steps (plural steps), so that the developing bias absolute value is stepwisely changed by ΔV/n for each step, so that the rise time and the fall time are prolonged. As a result, the period from the start of the rise of the developing bias to the completion of the rise of the developing bias is prolonged, so that the density can be gently changed to be less noticeable. That is, e.g., in the thick paper mode, as the process speed (the conveyance speed of the belt) is decreased, the density change per unit length on the image when the developing bias is changed is increased. The change amount per unit time of the bias is determined depending on the hardware constitution, so that there is the case where it is difficult to make the change. In such a case, it is necessary that the boundary is made less noticeably by dividing a predetermined amount of the bias change into portions to provide gradation to the boundary.

The values of ΔV and Δt are set so as to be increased in a mode in which the above-described impact-caused unevenness (density variation) is liable to be noticeable. Specifically, the values of ΔV and Δt are set to be larger with an increasing thickness of the sheet and to be larger in the monochromatic mode (second mode) than those in the full-color mode (first mode).

Figure 16:
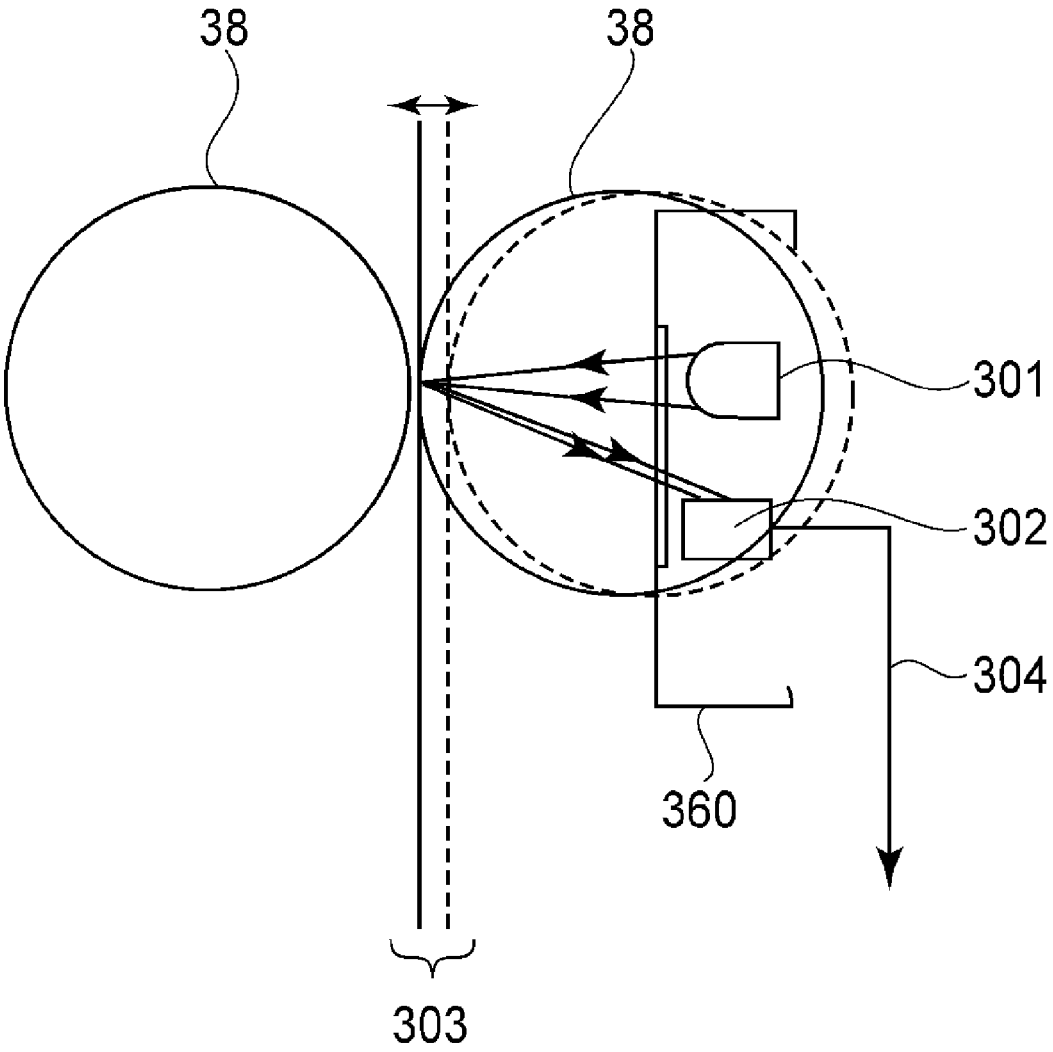
FIG. 16 is an illustration of a thickness detecting sensor of a recording material.

In FIG. 16, an example of a generally known thickness detection sensor (a recording material thickness detecting means) 360 is shown. The thickness detection sensor 360 is disposed at a position, in which the position of the sheet with respect to the thickness direction is stabilized, such as the neighborhood of the conveyance roller pair 38 which is not an idle roller.

Of the rollers of the conveyance roller pair 38, the roller located on a side opposite from a side on which the thickness detection sensor 360 is provided is required to be fixed. Light emitted from a light-emitting diode 301 is reflected by a reflection surface 303 as a measurement surface and then enters a light-receiving sensor 302. In this case, the reflection surface is the sheet surface. A light incident position relative to the light-receiving sensor 302 is changed depending on a distance of the reflection surface from the sensors, so that an analog signal depending on a light-receiving position is output. Under present circumstances, resolving power of such sensors is about several tens of microns, so that it is possible to detect a difference in medium thickness such that there is the need to change respective parameters of the electrophotographic process.

Also with respect to the impact-caused unevenness (density variation) generated with the timing when the trailing end of the sheet comes out of the T2 nip 99, a similar method is applicable. The movement speed of the belt 51 is instantaneously increased when the trailing end of the sheet S comes out of the T2 nip 99, and then is decreased. When the movement speed of the belt 51 is increased, a final image is decreased in density but the decreased density portion is less-visible as image defect. For that reason, also when the trailing end of the sheet S comes out of the T2 nip 99, the toner amount may preferably be decreased in the area in which the movement speed of the belt 51 is decreased. The image defect such that the density is decreased by the temporarily increased movement speed of the belt 51 may also be suppressed by increasing the toner amount. Further, there is a possibility that the speed variation of the belt 51 occurs also when the trailing end of the sheet S comes out of the T2 nip 99 in the case where the sheet S is conveyed by both of the T2 nip 99 and its upstream conveying rollers (the registration roller pair shown in FIGS. 1 and 2A. Also in this case, the generating position can be predicted, so that the above-described bias control is applicable. Further, the duration for which the developing bias is changed may also be, as described above, set at a value longer than the speed lowering duration Δt of the belt 51 in order to meet the variation in timing when the sheet S reaches the T2 nip 99 with respect to the toner image on the belt 51. Further, when the trailing end of the sheet comes out of the T2 nip 99, in the case where the speed of the belt 51 is increased and then is decreased, control such that the absolute value of the developing bias is increased and then decreased is also effective. In the above constitution, the control portion 101 is a charging bias control means for controlling an amount of application of the developing bias to the charging member 2 (2*a*-2*d*). The control portion 101 is also a developer feeding bias control means for controlling the amount of application of the developer feeding bias to the RS roller 7 (7*a*-7*d*). Further, the control portion 101 is a developer layer regulating bias control means for controlling the amount of application of the developer layer regulating bias to the blade 8 (8*a*-8*d*).

In this embodiment, different from JP-A 2004-302308, the image writing correction by the exposure means is not made, so that such an advantage that there is no need to consider the disadvantage of the occurrence of moire due to the interference between the dithering and the writing correction by the light exposure is obtained.

The constitution of the image forming apparatus in this embodiment is summarized as follows. The image forming apparatus includes at least one rotatable image bearing member 1 and the rotatable intermediary transfer member 51. Further, the apparatus includes the primary transfer member 50, located at the position in which the primary transfer member 50 opposes the image bearing member 1 through the intermediary transfer member 51, for transferring the developer image onto the intermediary transfer member 51 in the primary transfer nip 80 formed by the contact between the intermediary transfer member 51 and the image bearing member 1. Further, the apparatus includes the secondary transfer member 60, which forms the secondary transfer nip 99 in contact with the intermediary transfer member 51, for secondary-transferring the developer image from the intermediary transfer member 51 onto the recording material S. The apparatus further includes the conveying portion 38 for conveying the recording material S into the secondary transfer nip 99. The apparatus further includes the developer amount (weight) control means 101 for controlling the developer amount per unit area of the developer image to be formed on the image bearing member 1. The developer amount control means 101 effects the following control. That is, with the timing when the intermediary transfer member 51 causes the speed variation, the control means 101 changes the developer amount per unit area of the developer image to be transferred from the image bearing member 1 onto the intermediary transfer member 51 in the primary transfer nip 80 is changed with respect to the developer amount per unit area of the developer image to be transferred depending on the image information. The timing when the intermediary transfer member 15 causes the speed variation corresponds to the timing when the leading end of the recording material S enters the secondary transfer nip 99 or the timing when the trailing end of the recording material S comes out of the secondary transfer nip 99 or the conveying portion 38. With the timing, the developer amount control means 101 changes the developer amount per unit area of the developer image to be transferred from the image bearing member 1 onto the intermediary transfer member 51 in the primary transfer nip 80 so as to be decreased with respect to the developer amount per unit area of the developer image to be transferred depending on the image information. The image forming apparatus includes the developing means 4 including the rotatable developer carrying member 6 which constitutes the developing portion with respect to the image bearing member 1, and includes the developing bias application means 6*d*V for applying the voltage to the developer carrying member 6. The developer amount control means 101 is the developing bias control means for controlling the amount of application of the developing bias from the developing bias application means 6*d*V and changes the developing bias application amount in a predetermined value for a predetermined duration. As a result, the developer amount per unit area of the developer image to be transferred from the intermediary transfer belt 1 onto the intermediary transfer member 51 in the primary transfer nip 80 is changed with respect to the developer amount per unit area to be transferred depending on the image information. The developing bias control means 101 controls the developing bias so that the amount of change in developing bias application amount is larger with a larger thickness of the recording material S.

That is, in the case where the speed of the belt 51 is slow, the developing bias is controlled so that the potential difference between the image portion potential of the latent image and the developing bias potential when the recording material S has the large thickness is smaller than that when the recording material S has the small thickness. In the case where the speed of the belt 51 is fast, the developing bias is controlled so that the potential difference between the image portion potential of the latent image and the developing bias potential when the recording material S has the large thickness is larger than that when the recording material S has the small thickness.

The image forming apparatus is operable in the first mode in which the image is formed by the plurality of image bearing members and in the second mode in which the image is formed in the state in which a part of the plurality of image bearing members is separated from the intermediary transfer member. Even in the case where the thickness of the recording material is the same both in the first mode and the second mode, the developing bias control means controls the amount of change in developing bias application amount so as to be larger in the second mode than that in the first mode. That is, in the case where the speed of the belt 51 is slow, the developing bias is controlled so that the potential difference between the image portion potential of the latent image and the developing bias potential in the second mode is smaller than that in the first mode. On the other hand, in the case where the speed of the belt 51 is fast, the developing bias is controlled so that the potential difference between the image portion potential of the latent image and the developing bias potential in the second mode is larger than that in the first mode. Further, the period in which the developing bias application amount is changed by the predetermined value by the developing bias control means is gradually increased or gradually decreased.

(Embodiment 2)

Figure 8:
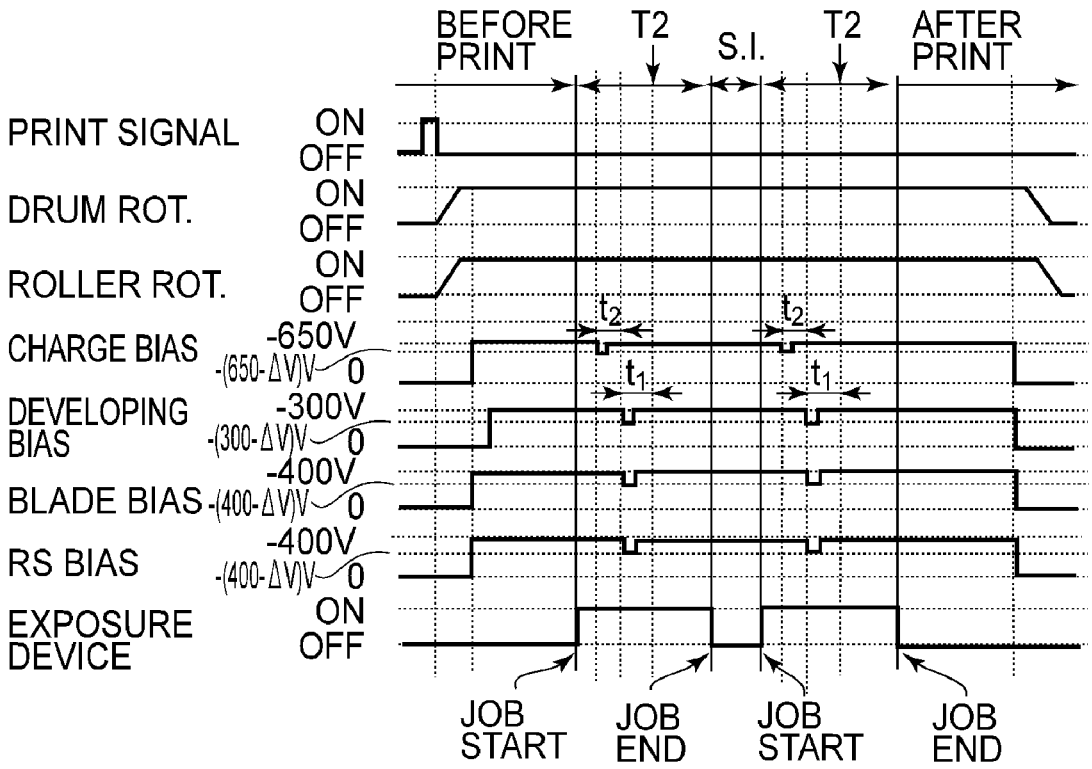
FIG. 8 is a timing chart of the image forming process in Embodiment 2.

In Embodiment 1, the method of decreasing the absolute value of the developing bias by the predetermined amount (ΔV) for the predetermined time (Δt) with timing when the leading end of the sheet enters the T2 nip 99 is described. However, there is the need to increase the developing bias change amount ΔV when the speed variation of the belt 51 is large, such as when the constitution in which the nip pressure in the T2 nip 99 is particularly large is employed or when the thick paper is passed through the T2 nip 99 in the monochromatic mode. In that case, when only the absolute value of the developing bias is changed, there is a possibility of an occurrence of a problem such that a difference of the developing bias absolute value from other bias set values (those of the developing bias, the RS bias and the blade bias) is largely changed. For example, when the difference between the developing blade bias and the developing bias is excessively small, the toner is deposited on the developing blade 12*d* and appears on the image in the form of streaks in some cases. Further, when the difference between the RS bias and the developing bias is excessively small, the toner is not satisfactorily supplied from the RS roller 6*d* to the developing roller 7*d*, so that there is a possibility of an occurrence of density non-uniformity on the image. When the difference between the charging bias and the developing bias is small, the toner is moved from the developing roller 7*d* to the drum 1*d* also at the non-exposed portion to cause the occurrence of image defect in some cases. Therefore, in this embodiment, in order to keep the balance between the developing bias and other biases (the charging bias, the RS bias and the blade bias), other biases are also decreased with the timing when the absolute value of the developing bias is decreased. That is, in order to suppress the occurrence of the toner deposition or the transfer failure, the bias to be changed is not only the developing bias. Other biases (the developing bias, the RS bias and the blade bias) are also changed by the same amount for the same duration. The timing chart of image formation in this embodiment is shown in FIG. 8. Here, with respect to the bias change amount and the bias change duration, when the developing bias absolute value is decreased by ΔV for Δt, other biases (the charging bias, the RS bias and the blade bias) are also decreased by the same amount for the same duration. Further, with respect to the timing, the biases except the developing bias may be decreased with the same timing as the developing bias. The change start timing of the developing bias is changed to the time antecedent to the change start timing of the developing bias absolute value by $t_2$. Referring to FIG. 5(*a*), $t_2$ can be represented by $q/V_0$ when q is a distance from the center of the nip formed between the charging roller 2*d* and the drum 1*d* to the center of the nip formed between the developing roller 6*d* and the drum 1*d*, and $V_0$ is the surface speed of the drum 1*d* (=the conveyance speed of the belt). As a result, in this embodiment, also in the case where the developing bias application amount is largely changed in the developing bias control, the above-described other biases are changed by the same amount with proper timing to keep the differences among the respective biases. Thus, with no disadvantage, the effect of Embodiment 1 can also be achieved in this embodiment (Embodiment 2). Further, in this embodiment, as other biases, the three biases of the charging bias, the RS bias and the blade bias are used but the bias is not applied in some constitution of the image forming apparatus. In such a case, the bias application amount of only the applied bias may only be required to be changed in the above-described manner.

The constitution of the image forming apparatus in this embodiment is summarized as follows. The image forming apparatus includes the charging member 2 for electrically charging the surface of the image bearing member 1, the charging bias application means 2*d*V for applying the charging bias to the charging member 2, and the charging bias control means 101 for controlling the charging bias application amount. The apparatus also includes the developer feeding member 7 for feeding the developer in contact with or in proximity to the developer carrying member 6, the developer feeding bias application means 7*d*V for applying the developer feeding bias to the developer feeding member 7, and the developer feeding bias control means 101 for controlling the developer feeding bias application amount. The apparatus further includes the developer layer regulating member 12 press-contactable to the surface of the developer carrying member 6, the developer layer regulating bias application means 12*d*V for applying the developer layer regulating bias to the developer layer regulating member, and the developer layer regulating bias control means 101 for controlling the developer layer regulating bias application amount. The respective bias control means for the charging, the developer feeding, and the developer layer regulation changes the respective biases for the charging, the developer feeding, and the developer layer regulation by the predetermined amounts for the predetermined durations with predetermined timing depending on the amount of change in developing bias application amount. The timing when the bias application amounts are changed by the respective control means for the developer feeding and the developer layer regulation is timed to the change of the bias application amount by the developing bias control means. The timing when the bias application amount is changed by the charging bias control means is timed so that the charging bias application amount at the portion at which the developing bias application amount with respect to the image bearing member is to be changed. The change amounts and the change durations of the respective bias application amounts by the respective bias control means for the charging, the developer feeding, and the developer layer regulation are made equal to those of the developing bias application amount by the developing bias control means.

(Embodiment 3)

The impact-caused unevenness due to the speed variation of the intermediary transfer belt is also generated in cases other than the case where the sheet enters the transfer portion or comes out of the transfer portion in the in-line type full-color laser beam printer described in Embodiment 1.

In this embodiment, the case where the present invention is applied to the impact-caused unevenness generated due to the speed variation by the contact and separation of the secondary transfer roller or the cleaning roller when a four color-based (four-pass) full-color laser beam printer of the electrophotographic type is used will be described.

Figure 9:
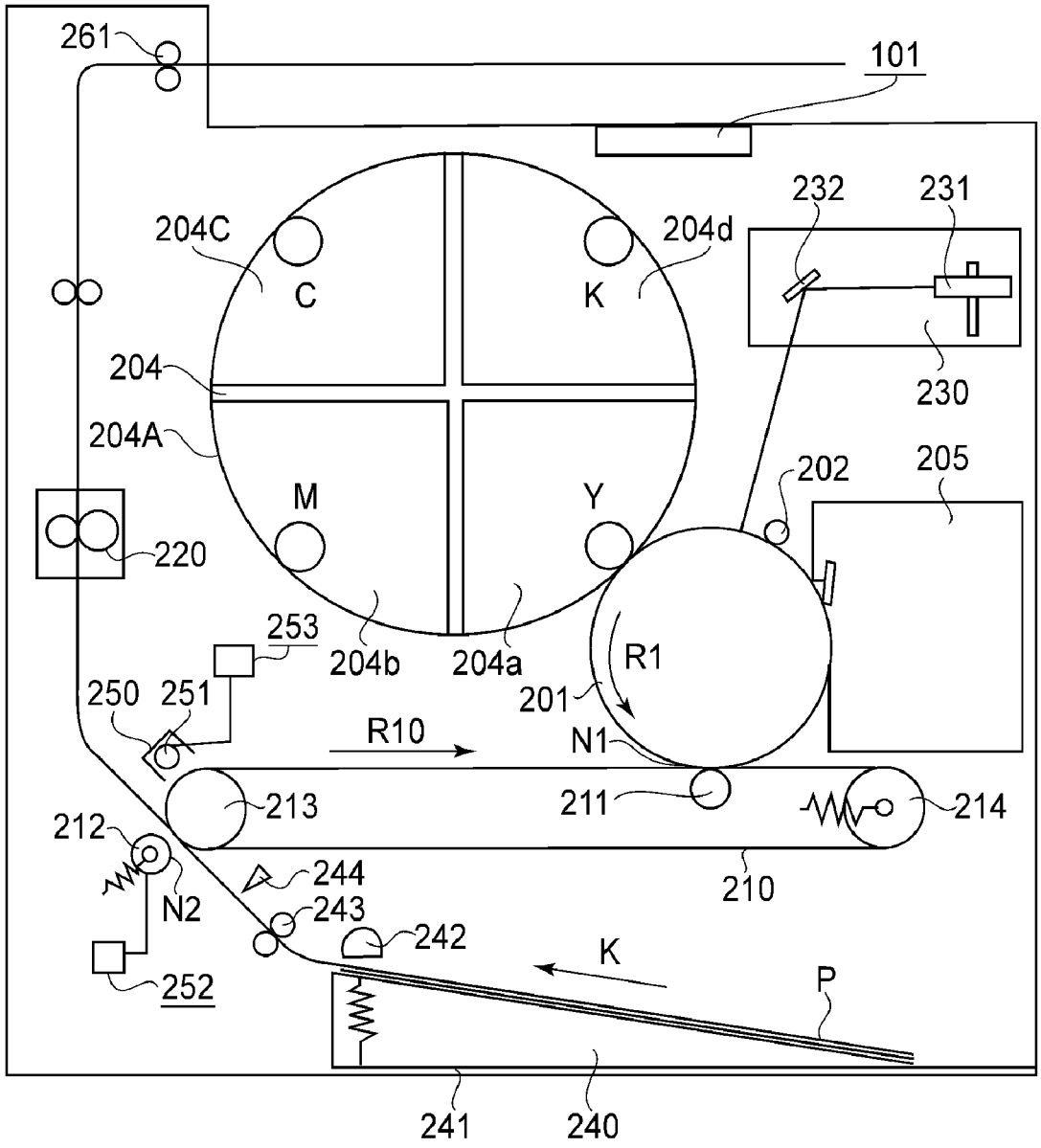
FIG. 9 is a schematic illustration of an image forming apparatus in Embodiment 3.

FIG. 9 is a schematic sectional view showing a structure of an image forming apparatus 200 according to the present invention.

The image forming apparatus 200 shown in FIG. 9 includes a drum-type electrophotographic photosensitive member 201 as a first image bearing member (hereinafter referred to as a photosensitive drum). The photosensitive drum 201 is rotatably supported in the image forming apparatus 200 and is rotationally driven in a direction indicated by an arrow R1 by a driving means (not shown). Around the photosensitive drum 201, the following devices are disposed along a rotational direction of the photosensitive drum 201 in the order listed below. That is, a charging roller 202 of a contact type for electrically charging the surface of the photosensitive drum 201 uniformly, an exposure device 230 for forming an electrostatic latent image by irradiating the surface of the photosensitive drum 201 with laser light depending on image information, a developing device 204 for developing the electrostatic latent image into a toner image by depositing the toner on the latent image, an intermediary transfer belt 201 (intermediary transfer member; hereinafter referred to as a belt) as a second image bearing member onto which the toner image is primary-transferred from the photosensitive drum 201, and a photosensitive drum cleaning device 205 for removing primary transfer residual toner remaining on the surface of the photosensitive drum 201 are disposed.

Inside the belt 210, a primary transfer roller 211 is disposed and urges the belt 210 against the photosensitive drum 201 surface to form a primary transfer nip N1 between the photosensitive drum 201 and the belt 210. To the primary transfer roller 211, a primary transfer bias is applied by a power source (not shown). Outside the belt 210, a secondary transfer roller 212 is disposed and is capable of forming a secondary transfer nip N2 between the belt 210 and itself. To the secondary transfer roller 212, a secondary transfer bias is applied by a power source (not shown). A cleaning roller (intermediary transfer member cleaning member) 251 of an electrostatic intermediary transfer belt cleaning device 250 is disposed oppositely to the belt 210. To the cleaning roller 251, a bias of an opposite polarity to the normal charge polarity of the toner is applied, so that the toner on the belt 210 is electrically chargeable to the opposite polarity to the normal charge polarity thereof.

The secondary transfer roller 212 and the cleaning roller 251 are disposed so that they are movable toward and away from the belt 210. A secondary transfer roller contact-and-separation means 253 is a mechanical mechanism using a cam or the like. As an example of a general constitution thereof, the contact and separation are performed by moving the secondary transfer roller 212 contacting the belt 210 at a predetermined pressure to a retracted position together with a member which holds the secondary transfer roller 212 by using the cam or the like. A cleaning roller contact-and-separation means 253 is similarly the mechanical mechanism using the cam or the like. The control portion 101 controls the secondary transfer roller contact-and-separation means 253 and the cleaning roller 251. The timing of the contact and separation will be described later.

On a downstream side of the secondary transfer N2 with respect to the conveyance direction (an arrow K direction) of a transfer material P, a fixing device 220 for fixing the toner image transferred onto the transfer material P under heat and pressure is disposed.

The constituent members of the image forming apparatus 200 will be described more specifically.

The photosensitive drum 201 is constituted by providing a photoconductive layer of an organic photoconductor (OPC), amorphous silicon (a-Si), or the like on an outer peripheral surface of an aluminum cylinder.

The charging roller 202 is constituted by a core metal and an electroconductive elastic member surrounding the periphery of the core metal and is disposed in contact with the surface of the photosensitive drum 201. The charging roller 202 is rotated by the rotation of the photosensitive drum 201 and a charging bias is applied thereto by a power source (not shown).

The exposure device 230 includes a laser oscillator (not shown) for emitting laser light L depending on the image information, a polygon mirror 231, a mirror 232, and the like and exposes to light the charged surface of the photosensitive drum 1, thus forming the electrostatic latent image.

The developing device 204 includes a rotatable member 204A and four color developing devices which are mounted therein and which consist of a yellow developing device 204*a*, a magenta developing device 204*b*, a cyan developing device 204*c*, and a black developing device 204*d*. By rotating the rotatable member 204A by a driving means (not shown), the developing devices are capable of being disposed in sequence at a developing position opposing the photosensitive drum 1 surface. When a four color-based full-color image is formed, first, the yellow developing device 204*a* is disposed at the developing position and then other developing devices are successively disposed at the developing position.

The belt 210 is formed in an endless shape and is extended around two parallel supporting rollers consisting of a driving roller 213 and a tension roller 214. The tension roller 214 is driven and stretches the belt 210. The belt 210 is driven (moved) in an arrow R10 direction by the rotation of the driving roller 213 by a driving means (not shown). The belt 210 may be formed of a material including a 50-200 μm thick resin film, having a volume resistivity of $10^8$-$10^{16}$ ohm·cm, such as PVDF (polyvinylidene fluoride), ETFE (polyethylene-tetrafluoroethylene), polyimide PET (polyethylene terephthalate) or polycarbonate, and including a 0.5-2 mm thick layer of a rubber material such as EPDM as a base material.

The primary transfer roller 211 described above is disposed at a position in which the primary transfer roller 211 substantially opposes the photosensitive drum 201 at an inner peripheral surface of the belt 210 and urges the belt 210 against the surface of the photosensitive drum 201 to form the primary transfer nip N1. Further, the secondary transfer roller 212 described above is contactable to the outer peripheral surface of the belt 210 at the position in which the secondary transfer roller 212 opposes the driving roller 213, thus forming the secondary transfer nip N2 between the belt 210 and itself. Further, the intermediary transfer belt cleaning device 250 described above is disposed oppositely to the surface of the belt 210 on a downstream side of the secondary transfer nip N2 and on an upstream side of the primary transfer nip N1. The intermediary transfer belt cleaning device 250 includes a cleaning roller (roller charger) 251 and an AC power source (not shown) and a DC power source (not shown) which are connected thereto.

A transfer material feeding device 240 feeds the transfer material P toward the image forming portion and is constituted by a transfer material cassette 241 in which a plurality of transfer materials P is accommodated, a feeding roller 242, registration rollers 243, and the like.

An operation of the image forming apparatus having the above-described constitution will be described.

The photosensitive drum 201 rotationally driven in the arrow R1 direction is electrically charged uniformly by applying to the charging roller 202 a charging bias in the form of a DC voltage biased with an AC voltage. When a yellow image signal is input into a laser oscillator (not shown), laser light is emitted, so that the charged surface of the photosensitive drum 201 is irradiated with the laser light, and an electrostatic latent image is formed on the photosensitive drum 201. When the photosensitive drum 201 is further rotated in the arrow R1 direction, onto the electrostatic latent image on the photosensitive drum 201, yellow toner is deposited, so that the latent image is developed into a yellow toner image. The yellow toner image on the photosensitive drum 201 is primary-transferred onto the belt 210 through the primary transfer nip N1 by applying a primary transfer bias to the primary transfer roller 211. The photosensitive drum 201 after the toner image transfer is, after primary transfer residual toner remaining on the surface thereof is removed by a photosensitive drum cleaning device 205, subjected to subsequent image formation.

The above-described series of the respective image forming processes of the charging, the exposure, the development, the primary transfer, and the cleaning is repeated also with respect to other three colors, i.e., magenta, cyan and black, so that four color toner images are formed on the belt 210. During the formation of the four color toner images from the photosensitive drum 201 to the belt 210, the secondary transfer roller 212 and the cleaning roller 251 are separated from the belt 210. Then, with timing when the four color toner images are transferred from the belt 210 onto the transfer material, the secondary transfer roller 212 and the cleaning roller 251 are brought into contact with the belt 210.

The four color toner images on the belt 210 are secondary-transferred onto the transfer material P, which has been conveyed in an arrow K direction, through the secondary transfer nip N2 by applying a secondary transfer bias to the secondary transfer roller 212 by a power source. The transfer material P after the toner image transfer is conveyed through the secondary transfer nip N2 to a fixing device 220, in which the toner images are melt-fixed on the transfer material P under heat and pressure, so that a four color-based full-color image is obtained on the transfer material.

Separately, on the belt 210 after the toner image transfer, the secondary transfer residual toner which has not been transferred onto the transfer material remains. The residual toner remaining on the belt 210 is removed by an intermediary transfer belt cleaning device 250 to be collected in the photosensitive drum cleaning device 205 through the photosensitive drum 201. That is, the residual toner is reversely charged, i.e., positively charged by the intermediary transfer belt cleaning device 250, thus being reversely transferred onto the photosensitive drum 201 through the primary transfer nip N1. The reversely transferred secondary transfer residual toner is removed by the photosensitive drum cleaning device 205 together with the primary transfer residual toner on the photosensitive drum 1.

Next, the generating mechanism of the impact-caused unevenness in the constitution of Embodiment 3 will be described. First, the impact-caused unevenness during the contact of the secondary transfer roller 212 and the cleaning roller 251 with the belt 210.

As described above, during the repetition of the series of the image forming processes of the charging, the exposure, the development, the primary transfer and the cleaning with respect to yellow, magenta and cyan, the secondary transfer roller 212 and the cleaning roller 251 are required to be spaced from the belt 210. Thereafter, during the primary transfer at the lowermost stream-side image forming portion, the secondary transfer roller 212 and the cleaning roller 251 contact the belt 210.

At that time, a load on the belt 210 is increased, so that the drive transmission member such as the gear or the like which drives the belt 210 is temporarily deformed due to load variation. As a result, the speed of the belt 210 is temporarily decreased. At that time, in the primary transfer nip N1 during the primary transfer, the speed of the belt 210 is slower than that of the photosensitive drum 201, so that a density is higher than that at other portions (at which the speed of the belt 210 is not decreased temporarily), thus resulting in the impact-caused unevenness.

Figure 10:
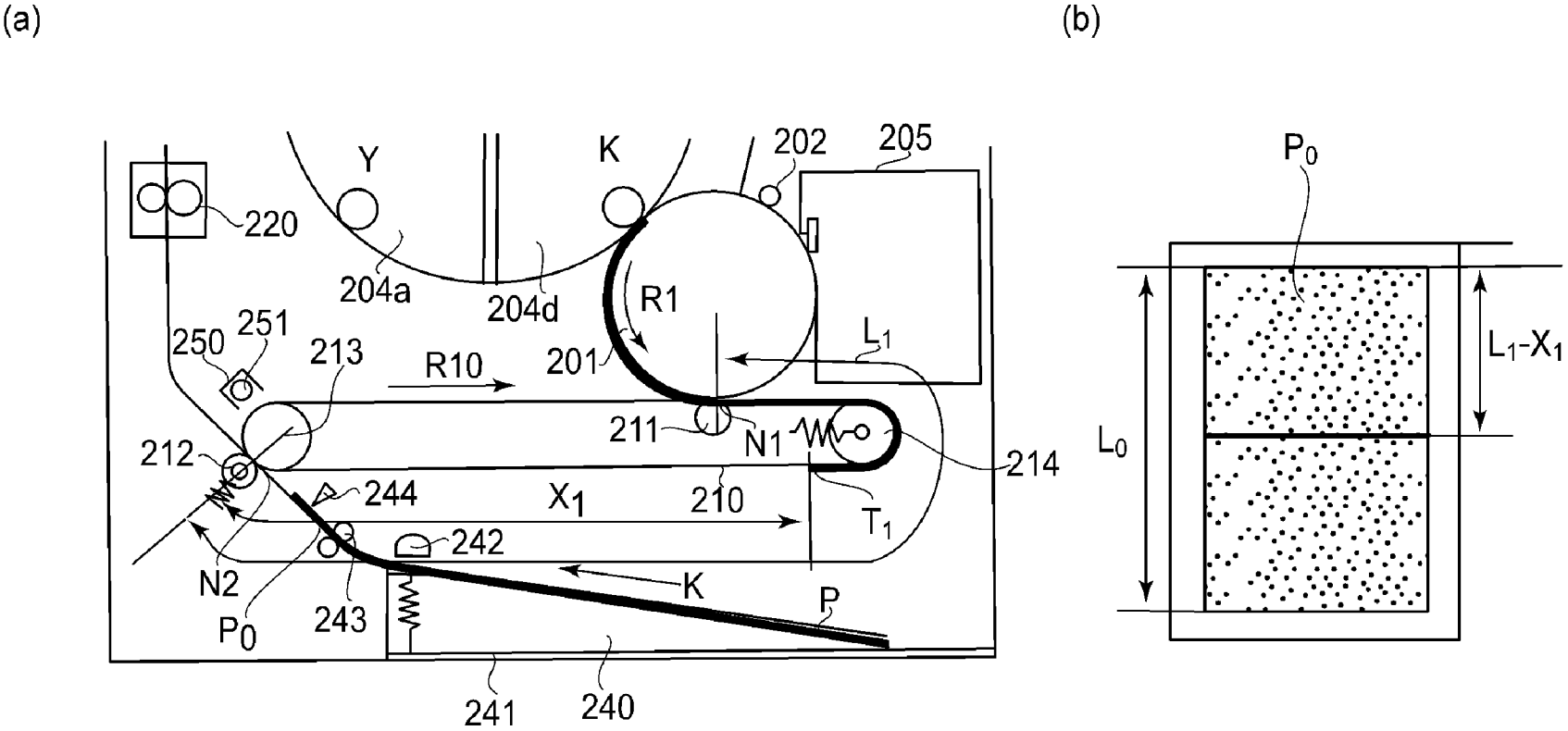
FIG. 10(*a*) is a schematic view showing the intermediary transfer portion at the instant when a secondary transfer roller contacts the intermediary transfer belt, and FIG. 10(*b*) is a schematic view showing a generation position of impact-caused unevenness on an image at the instant when the secondary transfer roller contacts the intermediary transfer belt.

Further, in this embodiment, similarly as in Embodiment 1, the generating position of the impact-caused unevenness can be predicted. A schematic view at the instant when the secondary transfer roller 212 contacts the belt 210 in a state in which the black developing device 204*d* contacts the drum 201 is shown in FIG. 10(*a*). Further, a generating position of the impact-caused unevenness on a sheet $P_0$ due to the contact of the secondary transfer roller 212 with the belt 210 is shown in FIG. 10(*b*). In FIG. 10(*b*), a length of an image area of the sheet $P_0$ is $L_0$ and a distance from the primary transfer nip N1 to the secondary transfer nip N2 with respect to the movement direction of the belt 210 is $L_1$. Further, a distance from the secondary transfer nip N2 to a writing leading end T1 of the toner image on the intermediary transfer belt at the instant when the secondary transfer roller 212 contacts the belt 210 is $X_1$. $L_0$ is a parameter determined by the sheet (paper) size and $L_1$ is a parameter determined by the constitution of a main assembly of the image forming apparatus. On the other hand, $X_1$ is a parameter determined by timing when the secondary transfer roller 212 is brought into contact with the belt 210.

The position of the occurrence of the impact-caused unevenness on the image caused by the contact of the secondary transfer roller 212 with the belt 210 is, as shown in FIG. 10(*b*), a portion ranging from the leading end of the image area to a position distant from the leading end by $(L_1-X_1)$.

The generating condition of the impact-caused unevenness is such that the above parameters satisfy: $0<L_1-X_1<L_0$. $X_1$ is set at a value as small as possible in order to prolong the lifetime of the secondary transfer roller 212, thus satisfying the condition: $0<L_1-X_1$ in many cases. Further, the impact-caused unevenness occurs when the sheet having the image area length $L_0$ satisfying: $L_1-X_1<L_0$ is used.

Figure 11:
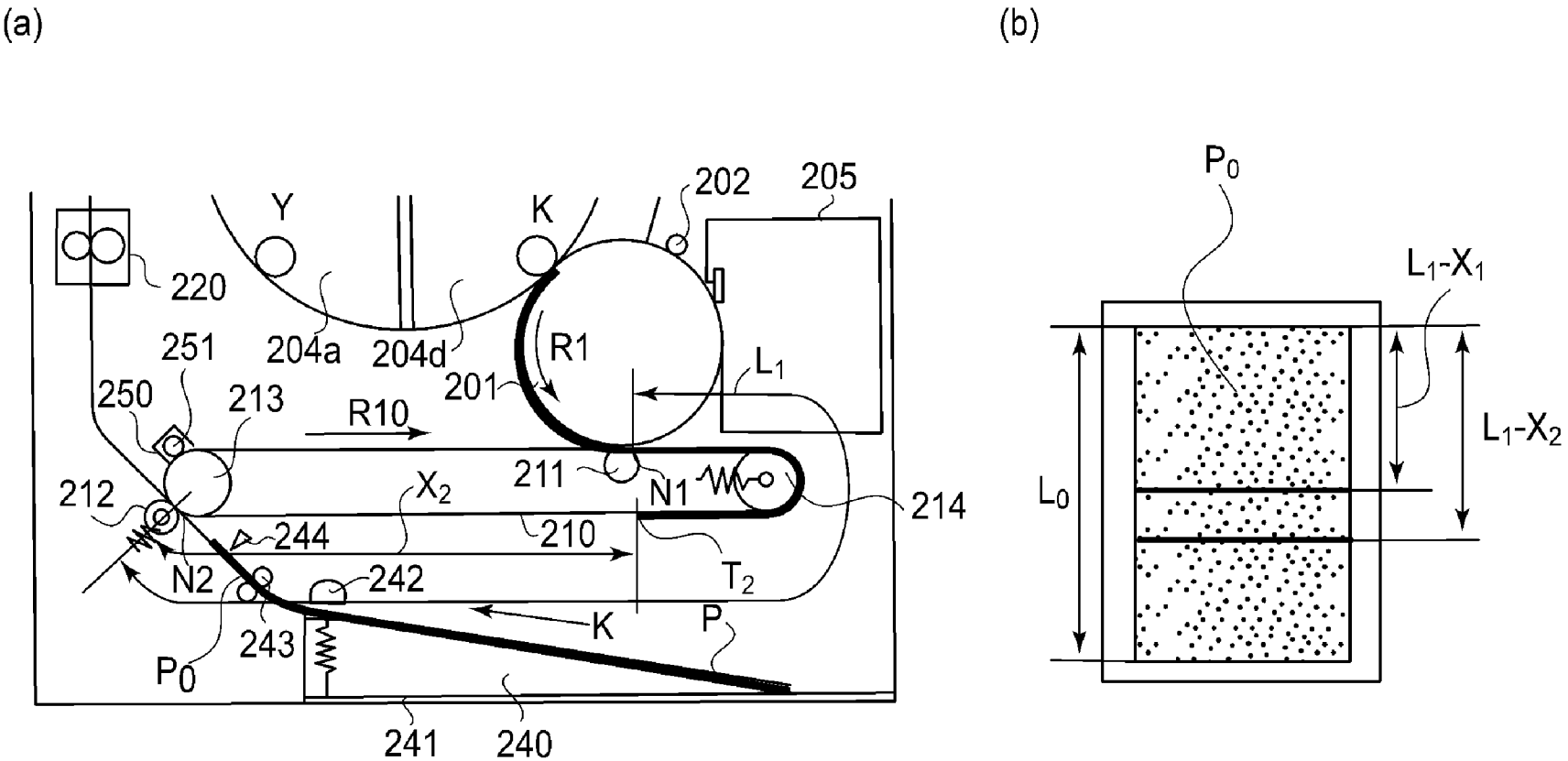
FIG. 11(*a*) is a schematic view showing the intermediary transfer portion at the instant when a cleaning roller contacts the intermediary transfer belt, and FIG. 11(*b*) is a schematic view showing the generation position of the impact-caused unevenness on the image at the instant when the cleaning roller contacts the intermediary transfer belt.

Next, a schematic view at the instant when the cleaning roller 251 contacts the belt 210 is shown in FIG. 11(*a*). Further, FIG. 11(*b*) shows the generating position of the impact-caused unevenness on the sheet $P_0$ caused due to the contact of the cleaning roller 251 with the belt 210. In FIG. 11(*b*), a distance from the secondary transfer nip N2 to a writing leading end $T_2$ of the toner image on the intermediary transfer belt at the instant when the cleaning roller 251 contacts the belt 210 is $X_2$. The generating position of the impact-caused unevenness on the image caused due to the contact of the cleaning roller 251 with the belt 210 is a portion ranging from the leading end of the image area to a position distant from the leading end by $(L_1-X_2)$. The contact of the cleaning roller 251 with the belt 210 may be timed to or deviated from the contact of the secondary transfer roller 212 with the belt 210. When the cleaning roller 251 and the secondary transfer roller 212 simultaneously contacts the belt 210, $X_1$ is equal to $X_2$, so that the impact-caused unevenness is generated on the image at the same position.

Next, the generating mechanism of the impact-caused unevenness when the secondary transfer roller 212 and the cleaning roller 251 are separated from the belt 210 will be described.

After the secondary transfer of the sheet (paper) $P_0$ in the secondary transfer nip N2 is completed, the secondary transfer roller 212 and the cleaning roller 251 are separated from the intermediary transfer belt 210. This is because the series of the respective image forming processes of the charging, the exposure, the development, the primary transfer, and the cleaning are repeated with respect to the yellow, cyan and magenta in order to prepare for the primary transfer of the subsequent sheet (paper) $P_1$ in the primary transfer nip N1.

During the separation of the secondary transfer roller 212 and the cleaning roller 251 from the belt 210, in the case where the yellow toner image for being transferred onto the subsequent sheet $P_1$ has been primary-transferred onto the belt 210, the belt 210 causes temporary speed variation. This is attributable to load variation of the belt 210 occurring during the separation from the belt 210. For that reason, the image density in the primary transfer nip in an area in which the temporary speed variation occurs is changed compared with that in the case where there is no temporary speed variation, thus resulting in the impact-caused unevenness. The speed variation in this case is generated due to the load variation such that the load on the belt 210 is temporarily decreased. Therefore, the belt 210 is moved fast correspondingly to jerky of the drive transmission member such as the gear or the like which drives the belt 210, so that the belt speed is increased. Thereafter, when the drive of the belt by the drive transmission member catches up with the first movement of the belt, the drive transmission member is temporarily deformed, so that the belt speed is decreased in some cases. Therefore, on the image, after there is a possibility that the impact-caused unevenness such that the density is decreased and then is increased is generated.

Next, the generating position of the impact-caused unevenness when the secondary transfer roller 212 and the cleaning roller 251 are separated from the belt 210 will be described.

Figure 12:
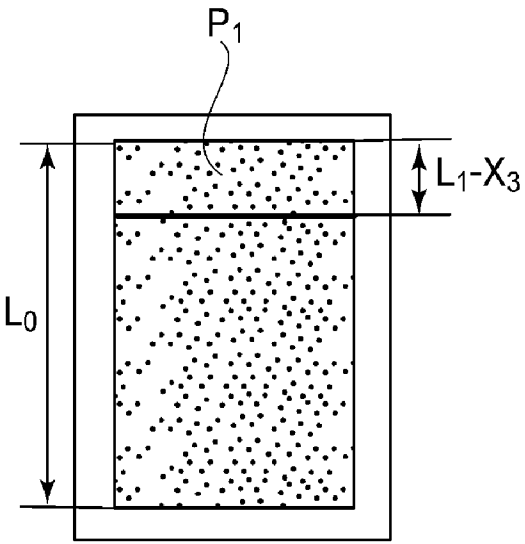
FIG. 12(*a*) is a schematic view showing the intermediary transfer portion at the instant when a secondary transfer roller is separated from the intermediary transfer belt, and FIG. 12(*b*) is a schematic view showing a generation position of impact-caused unevenness on an image at the instant when the secondary transfer roller is separated from the intermediary transfer belt.
Figure 12:
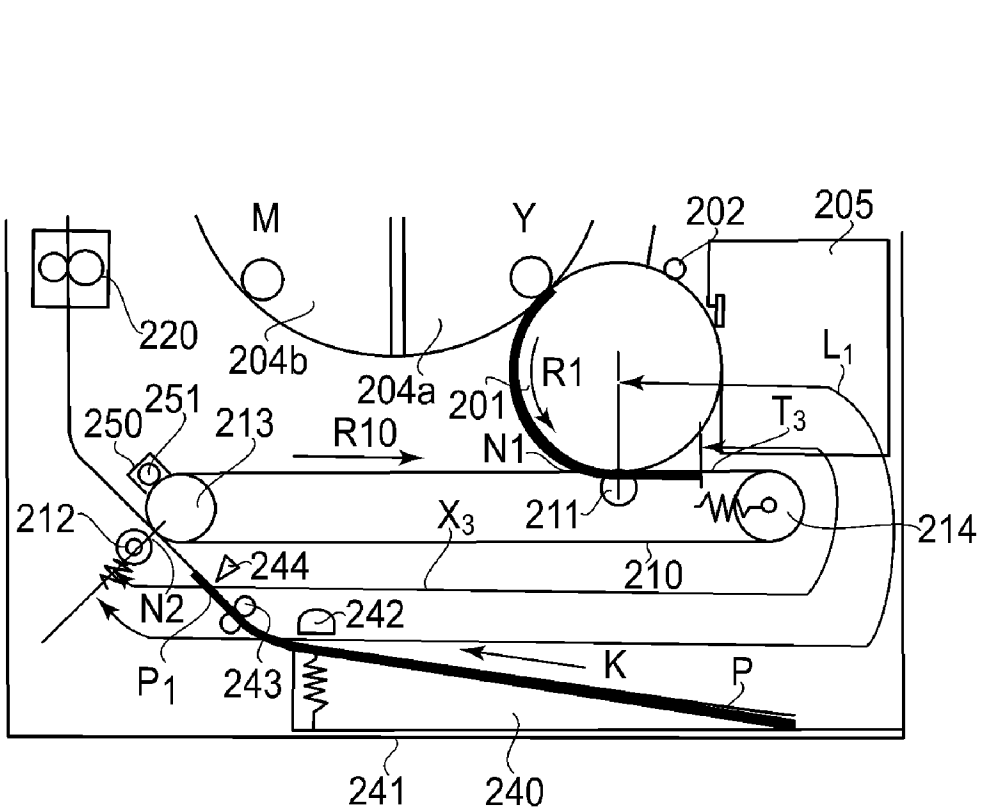

A schematic view at the instant when the secondary transfer roller 212 is separated from the belt 210 in a state in which the yellow developing device 204*a* contacts the drum 201 is shown in FIG. 12(*a*). Further, a generating position of the impact-caused unevenness on a sheet $P_0$ due to the separation of the secondary transfer roller 212 with the belt 210 is shown in FIG. 12(*b*). In FIG. 12(*b*), a length of an image area of the sheet $P_0$ is $L_0$ and a distance from the primary transfer nip N1 to the secondary transfer nip N2 with respect to the movement direction of the belt 210 is $L_1$. Further, a distance from the secondary transfer nip N2 to a writing leading end T3 of the toner image on the intermediary transfer belt at the instant when the secondary transfer roller 212 is separated from the belt 210 is $X_3$. $X_3$ is a parameter determined by timing when the secondary transfer roller 212 is separated from the belt 210.

The position of the occurrence of the impact-caused unevenness on the image caused by the separation of the secondary transfer roller 212 from the belt 210 is, as shown in FIG. 12(*b*), a portion ranging from the leading end of the image area to a position distant from the leading end by $(L_1-X_3)$.

However, the above parameters are required to satisfy: $0<L_1-X_3<L_0$.

For example, in the case where $X_3$ is set to satisfy $L_1<X_3$ by being set so that the secondary transfer roller 212 is separated from the belt 210 as soon as possible, when the secondary transfer of the sheet $P_0$ is completed, in order to prolong the lifetime of the secondary transfer roller 212, the impact-caused unevenness does not occur.

Figure 13:
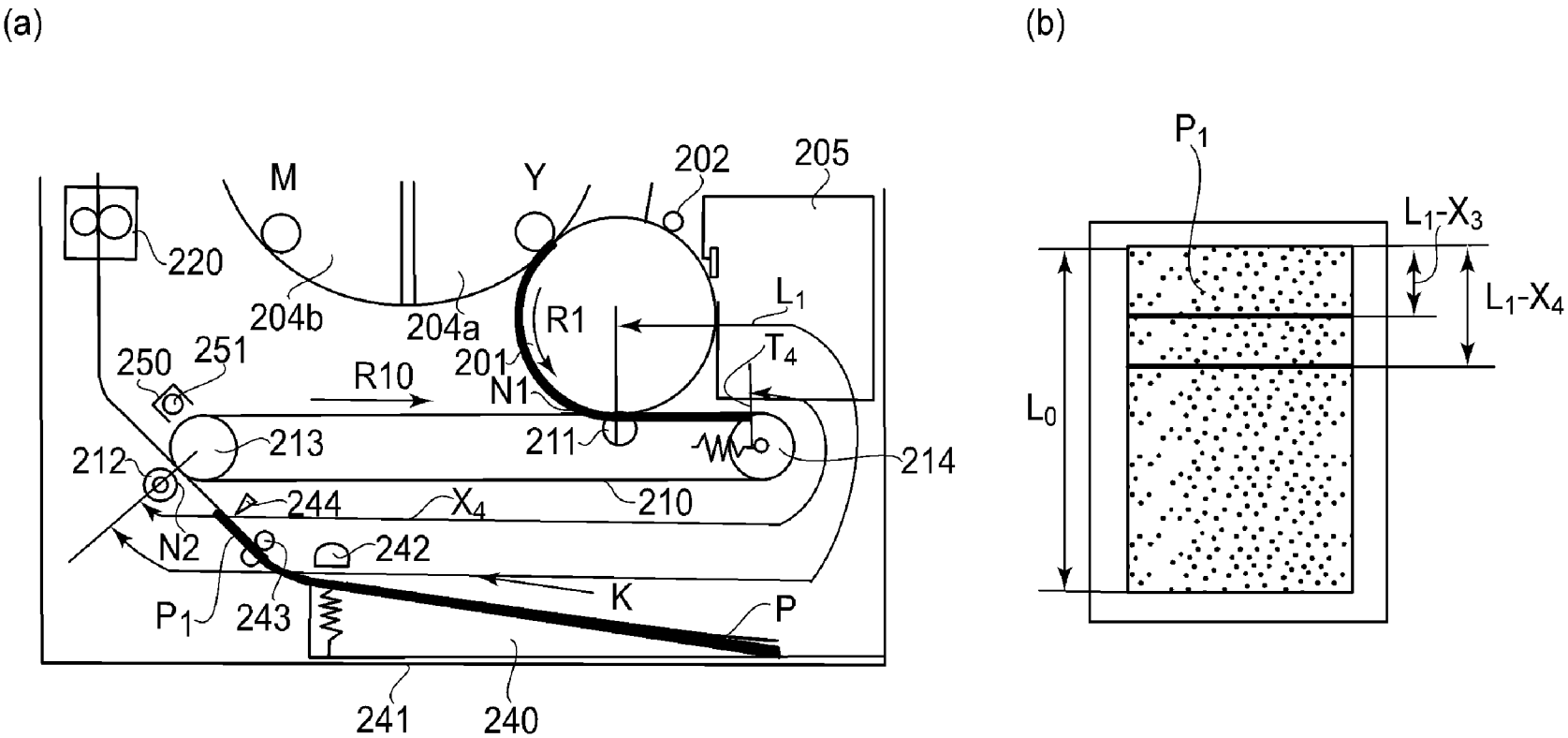
FIG. 13(*a*) is a schematic view showing the intermediary transfer portion at the instant when a cleaning roller is separated from the intermediary transfer belt, and FIG. 13(*b*) is a schematic view showing the generation position of the impact-caused unevenness on the image at the instant when the cleaning roller is separated from the intermediary transfer belt.

Next, a schematic view at the instant when the cleaning roller 251 is separated from the belt 210 in the state in which the yellow developing device 204*a* contacts the drum 201 after the secondary transfer roller 212 is separated from the belt 210 is shown in FIG. 13(*a*). Further, FIG. 13(*b*) shows the generating position of the impact-caused unevenness on the sheet $P_0$ caused due to the separation of the cleaning roller 251 from the belt 210. In FIG. 13(*b*), a distance from the secondary transfer nip N2 to a writing leading end $T_4$ of the toner image on the intermediary transfer belt at the instant when the cleaning roller 251 is separated from the belt 210 is $X_4$. $X_4$ is a parameter determined by timing when the cleaning roller 251 is separated from the belt 210. The generating position of the impact-caused unevenness on the image caused due to the separation of the cleaning roller 251 from the belt 210 is, as shown in FIG. 13(*b*), a portion ranging from the leading end of the image area to a position distant from the leading end by $(L_1-X_4)$. However, as the generating condition, the parameters are required to satisfy: $0<L_1-X_4<L_0$.

Further, in the case where the cleaning roller 251 is separated from the belt 210 with the same timing as that of the secondary transfer roller 212, $X_3$ is equal to $X_4$, so that the impact-caused unevenness occurs at the same position on the image.

In this embodiment, the method of suppressing the impact-caused unevenness (density variation) is similar to that in Embodiment 1. During the contact of the secondary transfer roller 212 and the cleaning roller 251 with the belt 210, the present invention is applied to the developing bias for black. Further, during the separation, the present invention is applied to the developing bias for yellow. That is, in an area in which the density is increased due to the lowering in speed of the belt 210 to cause the impact-caused unevenness, the developing bias is controlled so that the toner density on the photosensitive drum is smaller than that in an area in which the impact-caused unevenness does not occur. On the other hand, in an area in which the density is decreased due to the increase in speed of the belt 210 to cause the impact-caused unevenness, the developing bias is controlled so that the toner density is higher than that in the area in which the impact-caused unevenness does not occur.

As described above, in the four color-based (four-pass) full-color laser beam printer, the impact-caused unevenness generated due to the temporary speed variation of the belt 210 caused by the movement of the secondary transfer roller 212 and the cleaning roller 251 toward and away from the belt 210 can be suppressed similarly as in Embodiment 1. Also in the four color-based (four-pass) full-color laser beam printer, the impact-caused unevenness is generated at the primary transfer portion N1 and the generating position thereof on the image can be predicted. For that reason, even in the image forming apparatus having the constitution in this embodiment, the method of suppressing the impact-caused unevenness (density variation) is applicable. Incidentally, in this embodiment, the constitution of Embodiment 2 in which when the developing bias is changed, other biases (the charging bias, the RS bias and the blade bias) are similarly changed may also be employed.

(Embodiment 4)

In Embodiment 1, the constitution in which the developing bias is controlled as the means for suppressing the impact-caused unevenness such that the belt speed is temporarily decreased and thus the density in a part of the image area is increased is described. Specifically, the potential difference between the developing roller potential and the image portion potential of the latent image is decreased by reducing the absolute value of the amount of application of the developing bias, so that the toner amount on the drum is made smaller than that corresponding to the image data.

In this embodiment (Embodiment 4), a method of decreasing the toner amount on the belt compared with the toner amount corresponding to the image data by decreasing the potential difference between the primary transfer roller potential and the image portion potential on the drum through reduction of the primary transfer bias absolute value will be described. Other constitutions are identical to those in Embodiment 1, thus being omitted from redundant description.

In this embodiment, a method of controlling the amount of the toner moved from the drum to the belt by decreasing a transfer contrast which is a potential difference between a primary transfer roller potential and the image portion potential on the drum is utilized. For example, as described in Embodiment 1, when the leading end of the sheet S enters the T2 nip 99, the speed of the belt 51 is decreased and thus the toner density on the belt in the T1 nip 80 is increased.

Figure 14:
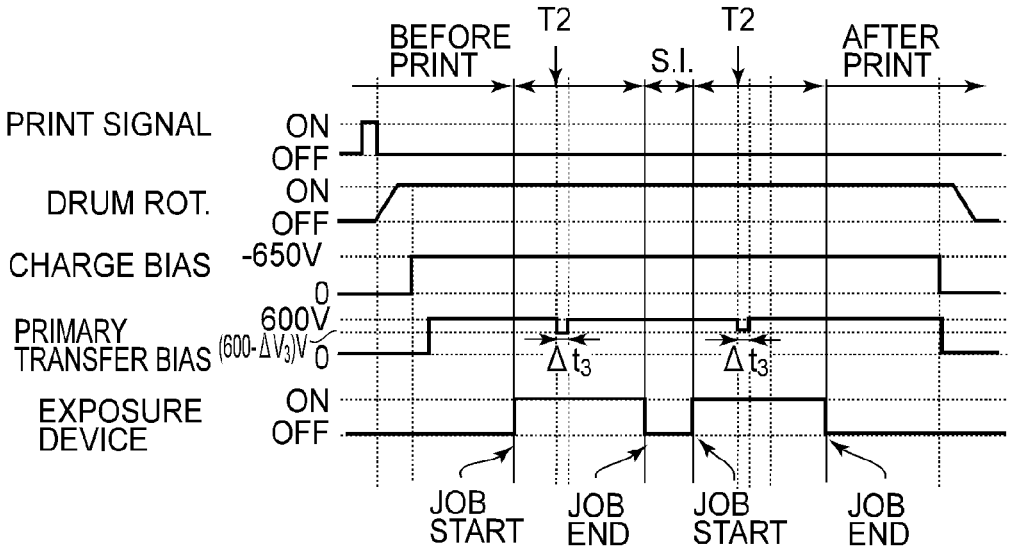
FIG. 14 is a timing chart of an image forming process in Embodiment 4.

FIG. 14 shows a timing chart in the case where two sheets are continuously passed through the T2 nip 99.

In this embodiment, with timing when the leading end of the sheet S, the primary transfer bias is decreased by $\Delta V_3$ for a time $\Delta t_3$. As a result, in the area in which the toner density is increased by the impact-caused unevenness, the transfer contrast is decreased, so that the amount of the toner moved from the drum to the belt is decreased. For that reason, it is possible to suppress the toner density variation on the belt between in the area in which the toner density is increased by the impact-caused unevenness and in other areas.

Further, in this embodiment, as the means for suppressing the impact-caused unevenness such that the density is decreased due to temporary increase in belt speed, the transfer bias may also be controlled. Specifically, the potential difference between the primary transfer roller potential and the image portion potential on the drum is increased by increasing the absolute value of the primary transfer bias, so that the toner amount on the belt is made larger than that corresponding to the image data. The thickness of the sheet, the optimization of the absolute value of the primary transfer bias in the monochromatic mode/full-color mode and the method of gradually changing the primary transfer bias are applicable to this embodiment similarly as in the case of the developing bias control in Embodiment 1.

That is, in the case where the speed of the belt 51 is slow, the transfer bias is controlled so that the potential difference between the image portion potential of the latent image and the transfer bias potential when the recording material S has the large thickness is smaller than that when the recording material S has the small thickness. In the case where the speed of the belt 51 is fast, the transfer bias is controlled so that the potential difference between the image portion potential of the latent image and the transfer bias potential when the recording material S has the large thickness is larger than that when the recording material S has the small thickness.

The image forming apparatus is operable in the first mode in which the image is formed by the plurality of image bearing members and in the second mode in which the image is formed in the state in which a part of the plurality of image bearing members is separated from the intermediary transfer member. Even in the case where the thickness of the recording material is the same both in the first mode and the second mode, the amount of change in transfer bias application amount is controlled so as to be larger in the second mode than that in the first mode. That is, in the case where the speed of the belt 51 is slow, the transfer bias is controlled so that the potential difference between the image portion potential of the latent image and the transfer bias potential in the second mode is smaller than that in the first mode. On the other hand, in the case where the speed of the belt 51 is fast, the transfer bias is controlled so that the potential difference between the image portion potential of the latent image and the transfer bias potential in the second mode is larger than that in the first mode. Further, the period in which the transfer bias application amount is changed by the predetermined value by the transfer bias control means is gradually increased or gradually decreased. Further, the constitution described above is also applicable to the impact-caused unevenness during the movement of the secondary transfer roller and the cleaning roller toward and away from the belt in the four color-based (four-pass) full-color laser beam printer described in Embodiment 3.

(Embodiment 5)

In Embodiment 1, the constitution in which the developing bias is controlled as the means for suppressing the impact-caused unevenness such that the belt speed is temporarily decreased and thus the density in a part of the image area is increased is described. In Embodiment 5, the potential difference between the developing roller potential and the image portion potential of the latent image is decreased by reducing the absolute value of the charging bias to decrease the image portion potential of the latent image on the drum. A method of decreasing the toner amount on the drum compared with the toner amount corresponding to the image data will be described. In this embodiment, a basis constitution is similar to that in Embodiment 1. A difference of this embodiment from Embodiment 1 is that the charging bias, not the developing bias is changed as the means for suppressing the impact-caused unevenness in this embodiment and that the developing method in this embodiment is a normal developing method in which the toner is deposited at the non-exposed portion.

By changing the absolute value of the developing bias as in Embodiment 1, the developing contrast which is the difference between the developing bias and the image portion potential of the latent image is changeable. In Embodiment 5, the developing contrast is decreased by reducing the absolute value of the charging bias. Incidentally, in the case of the reverse development, the developing contrast can also be decreased by increasing the charging bias to increase the potential of the drum to be electrically charged before the image formation and to increase the portion at the exposed portion after the exposure.

Next, timing will be described. For example, as described in Embodiment 1, when the leading end of the sheet S enters the T2 nip 99, the speed of the belt 51 is decreased and thus the toner density on the belt in the T1 nip 80 is increased.

Figure 15:
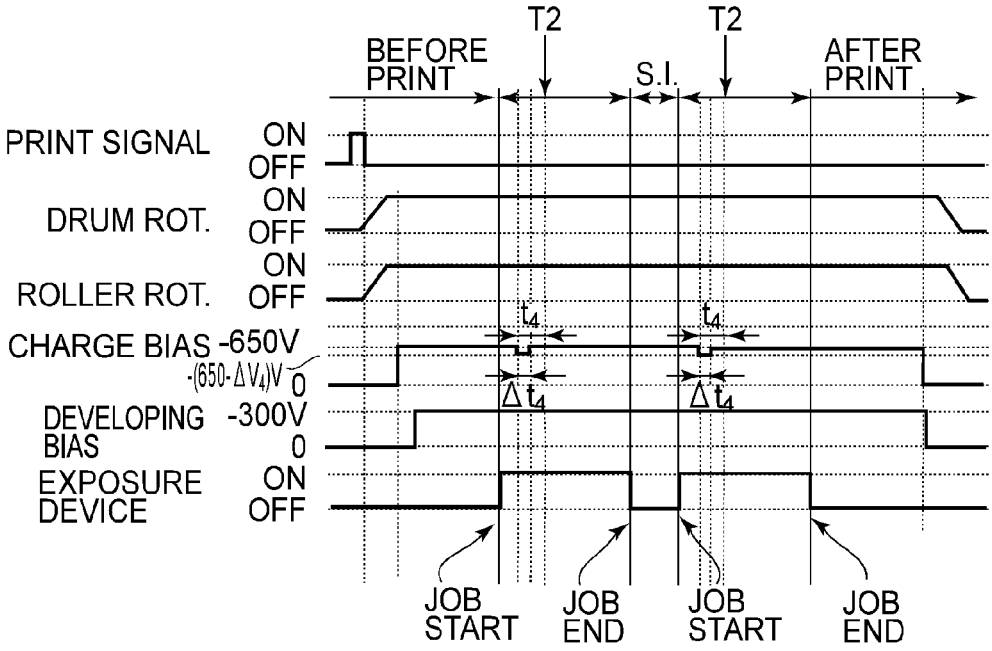
FIG. 15 is a timing chart of an image forming process in Embodiment 5.

FIG. 15 shows a timing chart in the case where two sheets are continuously passed through the T2 nip 99.

Timing when the charging bias absolute value is decreased by $\Delta V_4$ for a time $\Delta t_4$ will be described. The charging bias is changed at the time antecedent to the timing, when the leading end of the sheet enters the T2 nip 99, by $t_4$. Here, $t_4$ is a time calculated by dividing a distance from the center of the nip formed between the charging roller 2*d* and the drum 1*d* to the T1 nip 80*d* by the surface speed of the drum 1*d* (i.e., the conveyance speed of the belt). In Embodiment 5, the temporary change in developing bias is not made. As a result, in the area in which the toner density is increased by the impact-caused unevenness, the developing contrast is decreased, so that the amount of the toner moved from the drum to the belt is decreased. For that reason, it is possible to suppress the toner density variation on the belt between in the area in which the toner density is increased by the impact-caused unevenness and in other areas.

Further, in this embodiment, as the means for suppressing the impact-caused unevenness such that the density is decreased due to temporary increase in belt speed, the charging bias may also be controlled. By increasing the charging bias absolute value, the potential difference (developing contrast) between the developing bias and the image portion potential of the latent image is increased. As a result, the toner amount on the belt is made larger than that corresponding to the image data. The thickness of the sheet, the optimization of the values $\Delta V_4$ and $\Delta t_4$ in the monochromatic mode/full-color mode and the method of gradually changing the charging bias are similar to those in the case of the developing bias control in Embodiment 1.

That is, in the case where the speed of the belt 51 is slow, the charging bias is controlled so that the potential difference between the image portion potential of the latent image and the charging bias potential when the recording material S has the large thickness is smaller than that when the recording material S has the small thickness. In the case where the speed of the belt 51 is fast, the charging bias is controlled so that the potential difference between the image portion potential of the latent image and the charging bias potential when the recording material S has the large thickness is larger than that when the recording material S has the small thickness.

The image forming apparatus is operable in the first mode in which the image is formed by the plurality of image bearing members and in the second mode in which the image is formed in the state in which a part of the plurality of image bearing members is separated from the intermediary transfer member. Even in the case where the thickness of the recording material is the same both in the first mode and the second mode, the amount of change in charging bias application amount is controlled so as to be larger in the second mode than that in the first mode. That is, in the case where the speed of the belt 51 is slow, the charging bias is controlled so that the potential difference between the image portion potential of the latent image and the charging bias potential in the second mode is smaller than that in the first mode. On the other hand, in the case where the speed of the belt 51 is fast, the charging bias is controlled so that the potential difference between the image portion potential of the latent image and the charging bias potential in the second mode is larger than that in the first mode. Further, the period in which the charging bias application amount is changed by the predetermined value by the charging bias control means is gradually increased or gradually decreased. Further, the constitution described above is also applicable to the impact-caused unevenness during the movement of the secondary charging roller and the cleaning roller toward and away from the belt in the four color-based (four-pass) full-color laser beam printer described in Embodiment 3.

The constitutions described in Embodiment 1 to Embodiment 5 are summarized as follows.

The present invention is directed to suppress the image defect (impact-caused unevenness) caused to the temporary speed variation of the intermediary transfer member.

When the intermediary transfer member is temporarily decreased in speed, with that timing, the density of the toner image primary-transferred on the intermediary transfer member is increased. The area in which the toner density is increased can be predicted from the apparatus constitution or the like. Therefore, the toner density on the intermediary transfer member is controlled so as not to provide a difference between in an area (first area) in which the density increase is predicted and another area (second area). For example, by controlling the developing bias or the charging bias, the developing contrast in the first area is made smaller than that in the second area. Alternatively, by controlling the transfer bias, the transfer contrast in the first area is made smaller than that in the second area.

On the other hand, when the intermediary transfer member is temporarily increased in speed, with that timing, the density of the toner image primary-transferred on the intermediary transfer member is decreased. The area in which the toner density is decreased can be predicted from the apparatus constitution or the like. Therefore, the toner density on the intermediary transfer member is controlled so as not to provide a difference between in an area (third area) in which the density decrease is predicted and another area (second area). For example, by controlling the developing bias or the charging bias, the developing contrast in the third area is made larger than that in the second area. Alternatively, by controlling the transfer bias, the transfer contrast in the third area is made larger than that in the second area.

The temporary decrease in speed of the intermediary transfer member can be considered that it occurs with the following timing:

(1) when the leading end of the recording material enters the secondary transfer nip or when the trailing end of the recording material comes out of the secondary transfer nip or comes out of the conveying portion for conveying the recording material to the secondary transfer nip, (2) when the secondary transfer member is provided movably toward and separated from the intermediary transfer member and contacts the intermediary transfer member, and (3) when the intermediary transfer member cleaning member provided movably toward and away from the intermediary transfer member contacts the intermediary transfer member.

The temporary increase in speed of the intermediary transfer member can be considered that it occurs with the following timing:

(1) when the leading end of the recording material enters the secondary transfer nip or when the trailing end of the recording material comes out of the secondary transfer nip or comes out of the conveying portion for conveying the recording material to the secondary transfer nip, (2) when the secondary transfer member is provided movably toward and separated from the intermediary transfer member and is separated from the intermediary transfer member, and (3) when the intermediary transfer member cleaning member provided movably toward and away from the intermediary transfer member is separated from the intermediary transfer member.

Incidentally, when the leading end of the recording material enters the secondary transfer nip or when the trailing end of the recording material comes out of the secondary transfer nip or comes out of the conveying portion for conveying the recording material to the secondary transfer nip, the speed increase and speed decrease of the intermediary transfer member occur substantially at the same time. Therefore, by comparing the impact-caused unevenness due to the speed increase with the impact-caused unevenness due to the speed decrease, it is also possible to obviate one of the impact-caused unevennesses.

Further, the reason why the speed variation of the intermediary transfer member occurs is not limited to those described above. Even when the speed variation of the intermediary transfer member occurs, if a final image is within an acceptable range, there is no need to effect the control of the developing bias or the like with respect to all the speed variations as in the present invention.

Further, the correction amount of the developing bias or the like is changed depending on the thickness of the recording material and the image forming mode (the monochromatic mode or the full-color mode). Specifically, in the case where the speed variation of the intermediary transfer member is increased, the correction amount when the recording material thickness is large (or in the monochromatic mode) is made larger than that when the recording material thickness is small (or in the full-color mode).

Further, in the case where the developing bias or the like is changed, by gradually changing the bias, the density can also be not changed largely.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application Nos. 130218/2009 filed May 29, 2009, and 080986/2010 filed Mar. 31, 2010, which are hereby incorporated by reference.

What is claimed is:

1. An image forming apparatus comprising:

a rotatable image bearing member on which a latent image is to be formed;

a developing device, including a developer carrying member for carrying a developer and developing bias application means for applying a developing bias to the developer carrying member, for developing the latent image formed on said image bearing member into a developer image;

a rotatable intermediary transfer member;

a primary transfer member, provided opposed to said image bearing member through said intermediary transfer member, for forming a primary transfer nip by causing said intermediary transfer member to contact said image bearing member and for transferring the developer image from said image bearing member onto said intermediary transfer member;

a secondary transfer member, contactable to said intermediary transfer member to form a secondary transfer nip, for secondary-transferring the developer image from said intermediary transfer member onto a recording material;

wherein an area of said image bearing member in which the latent image for image formation on the recording material is to be formed includes a first area at least containing an area located in the primary transfer nip at a time when a speed of said intermediary transfer member is temporarily decreased and includes a second area located in the primary transfer nip when there is no temporary change in speed of said intermediary transfer member; and a control device for controlling a developing bias so that a potential difference between an image portion potential of the latent image and a potential of the developing bias to be applied to the developer carrying member when the latent image in the first area is developed is smaller than a potential difference between the image portion potential of the latent image and a potential of the developing bias to be applied to the developer carrying member when the latent image in the second area is developed.

2. An apparatus according to claim 1, wherein the time when the speed of said intermediary transfer member is temporarily decreased is a time when a leading end of the recording material enters the secondary transfer nip or a time when a trailing end of the recording material comes out of the secondary transfer nip or a conveying portion for conveying the recording material to the secondary transfer nip.

3. An apparatus according to claim 1, wherein said secondary transfer member is movable toward and away from said intermediary transfer member, and wherein the time when the speed of said intermediary transfer member is temporarily decreased is a time when said secondary transfer member contacts said intermediary transfer member.

4. An apparatus according to claim 1, further comprising an intermediary transfer member cleaning member provided movably toward and away from said intermediary transfer member, wherein the time when the speed of said intermediary transfer member is temporarily decreased is a time when said intermediary transfer member cleaning member contacts said intermediary transfer member.

5. An apparatus according to claim 1, wherein the developing bias to be applied to the developer carrying member when the latent image in the first area is developed is changed depending on a thickness of the recording material, and wherein the developing bias is controlled so that a potential difference between the image portion potential of the latent image and the developing bias when the thickness of the recording material is large is smaller than that when the thickness of the recording material is small.

6. An apparatus according to claim 1, wherein said image bearing member includes a plurality of image bearing member portions and said primary transfer member includes a plurality of primary transfer member portions, wherein said apparatus is operable in a first mode in which image formation is effected in a state in which the plurality of image bearing member portions and the plurality of primary transfer member portions contact said intermediary transfer member and is operable in a second mode in which the image formation is effected in a state in which a part of the plurality of image bearing member portions or the plurality of primary transfer member portions is separated from said intermediary transfer member, wherein the developing bias to be applied to the developer carrying member when the latent image in the first area is developed is changed depending on the first mode and the second mode even when a thickness of the recording material in the first mode is equal to that in the second mode, and wherein the developing bias is controlled so that a potential difference between the image portion potential of the latent image and the developing bias in the second mode is smaller than that in the first mode.

7. An apparatus according to claim 1, wherein a change from i) the developing bias to be applied to the developer carrying member when the latent image in the first area is developed to ii) the developing bias to be applied to the developer carrying member when the latent image in the second area is developed, or a change from ii) the developing bias to be applied to the developer carrying member when the latent image in the second area is developed to i) the developing bias to be applied to the developer carrying member when the latent image in the first area is developed is made by gradually decreasing or gradually increasing the developing bias.

8. An apparatus according to claim 1, further comprising at least one of the following component sets (A), (B) and (C):

(A) a charging member for electrically charging a surface of said image bearing member, charging bias applying means for applying a charging bias to the charging member, and charging bias control means for controlling an amount of application of the charging bias, (B) a developer supplying member for supplying the developer, developer supplying bias applying means for applying a developer supplying bias to the developer supplying member, and developer supplying bias control means for controlling an amount of application of the developer supplying bias, and (C) a developer layer regulating member press-contactable to the surface of the developer carrying member, developer layer regulating bias applying means for applying a developer layer regulating bias to the developer layer regulating member, and a developer layer regulating bias control means for controlling an amount of application of the developer layer regulating bias, wherein when said apparatus comprises the component set (A), said apparatus performs the following operation (a):

(a) the charging bias applying means changes the charging bias to be applied, when said image bearing member is electrically charged in the first area, correspondingly to an amount of a change in developing bias to be applied when the latent image in the first area is developed and changes the charging bias to be applied, when said image bearing member is electrically charged in the second area, correspondingly to an amount of a change in developing bias to be applied when the latent image in the second area is developed, wherein when said apparatus comprises the component set (B), said apparatus performs the following operation (b):

(b) the developer supplying bias applying means changes the developer supplying bias to be applied, when the latent image in the first area is developed, correspondingly to an amount of a change in developing bias to be applied when the latent image in the first area is developed and changes the developer supplying bias to be applied, when the latent image in the second area is developed, correspondingly to an amount of a change in developing bias to be applied when the latent image in the second area is developed, and wherein when said apparatus comprises the component set (C), said apparatus performs the following operation (c):

(c) the developer layer regulating bias applying means changes the developer layer regulating bias to be applied, when the latent image in the first area is developed, correspondingly to an amount of a change in developing bias to be applied when the latent image in the first area is developed and changes the developer layer regulating bias to be applied, when the latent image in the second area is developed, correspondingly to an amount of a change in developing bias to be applied when the latent image in the second area is developed.

9. An image forming apparatus comprising:

a rotatable image bearing member on which a latent image is to be formed;

a developing device, including a developer carrying member for carrying a developer and developing bias application means for applying a developing bias to the developer carrying member, for developing the latent image formed on said image bearing member into a developer image;

a rotatable intermediary transfer member;

a primary transfer member, provided opposed to said image bearing member through said intermediary transfer member, for forming a primary transfer nip by causing said intermediary transfer member to contact said image bearing member and for transferring the developer image from said image bearing member onto said intermediary transfer member;

a secondary transfer member, contactable to said intermediary transfer member to form a secondary transfer nip, for secondary-transferring the developer image from said intermediary transfer member onto a recording material;

wherein an area of said image bearing member in which the latent image for image formation on the recording material is to be formed includes a fluctuation area at least containing an area located in the primary transfer nip at a time when a speed of said intermediary transfer member is temporarily increased and includes a non-fluctuation area located in the primary transfer nip when there is no temporary change in speed of said intermediary transfer member; and a control device for controlling a developing bias so that a potential difference between an image portion potential of the latent image and a potential of the developing bias to be applied to the developer carrying member when the latent image in the fluctuation area is developed is smaller than a potential difference between the image portion potential of the latent image and a potential of the developing bias to be applied to the developer carrying member when the latent image in the non-fluctuation area is developed.

10. An apparatus according to claim 9, wherein the time when the speed of said intermediary transfer member is temporarily increased is a time when a leading end of the recording material enters the secondary transfer nip or a time when a trailing end of the recording material comes out of the secondary transfer nip or a conveying portion for conveying the recording material to the secondary transfer nip.

11. An apparatus according to claim 9, wherein said secondary transfer member is movable toward and away from said intermediary transfer member, and wherein the time when the speed of said intermediary transfer member is temporarily increased is a time when said secondary transfer member is separated from said intermediary transfer member.

12. An apparatus according to claim 9, further comprising an intermediary transfer member cleaning member provided movably toward and away from said intermediary transfer member, wherein the time when the speed of said intermediary transfer member is temporarily increased is a time when said intermediary transfer member cleaning member is separated from said intermediary transfer member.

13. An apparatus according to claim 9, wherein the developing bias to be applied to the developer carrying member when the latent image in the fluctuation area is developed is changed depending on a thickness of the recording material, and wherein the developing bias is controlled so that a potential difference between the image portion potential of the latent image and the developing bias when the thickness of the recording material is large is smaller than that when the thickness of the recording material is small.

14. An apparatus according to claim 9, wherein said image bearing member includes a plurality of image bearing member portions and said primary transfer member includes a plurality of primary transfer member portions, wherein said apparatus is operable in a first mode in which image formation is effected in a state in which the plurality of image bearing member portions and the plurality of primary transfer member portions contact said intermediary transfer member and is operable in a second mode in which the image formation is effected in a state in which a part of the plurality of image bearing member portions or the plurality of primary transfer member portions is separated from said intermediary transfer member, wherein the developing bias to be applied to the developer carrying member when the latent image in the fluctuation area is developed is changed depending on the first mode and the second mode even when a thickness of the recording material in the first mode is equal to that in the second mode, and wherein the developing bias is controlled so that a potential difference between the image portion potential of the latent image and the developing bias in the second mode is larger than that in the first mode.

15. An apparatus according to claim 9, wherein a change from i) the developing bias to be applied to the developer carrying member when the latent image in the fluctuation area is developed to ii) the developing bias to be applied to the developer carrying member when the latent image in the non-fluctuation area is developed, or a change from ii) the developing bias to be applied to the developer carrying member when the latent image in the non-fluctuation area is developed to i) the developing bias to be applied to the developer carrying member when the latent image in the fluctuation area is developed is made by gradually decreasing or gradually increasing the developing bias.

16. An apparatus according to claim 9, further comprising at least one of the following component sets (A), (B) and (C):

(A) a charging member for electrically charging a surface of said image bearing member, charging bias applying means for applying a charging bias to the charging member, and charging bias control means for controlling an amount of application of the charging bias, (B) a developer supplying member for supplying the developer, developer supplying bias applying means for applying a developer supplying bias to the developer supplying member, and developer supplying bias control means for controlling an amount of application of the developer supplying bias, and (C) a developer layer regulating member press-contactable to the surface of the developer carrying member, developer layer regulating bias applying means for applying a developer layer regulating bias to the developer layer regulating member, and a developer layer regulating bias control means for controlling an amount of application of the developer layer regulating bias, wherein when said apparatus comprises the component set (A), said apparatus performs the following operation (a):

(a) the charging bias applying means changes the charging bias to be applied, when said image bearing member is electrically charged in the fluctuation area, correspondingly to an amount of a change in developing bias to be applied when the latent image in the fluctuation area is developed and changes the charging bias to be applied, when said image bearing member is electrically charged in the non-fluctuation area, correspondingly to an amount of a change in developing bias to be applied when the latent image in the non-fluctuation area is developed, wherein when said apparatus comprises the component set (B), said apparatus performs the following operation (b):

(b) the developer supplying bias applying means changes the developer supplying bias to be applied, when the latent image in the fluctuation area is developed, correspondingly to an amount of a change in developing bias to be applied when the latent image in the fluctuation area is developed and changes the developer supplying bias to be applied, when the latent image in the non-fluctuation area is developed, correspondingly to an amount of a change in developing bias to be applied when the latent image in the non-fluctuation area is developed, and wherein when said apparatus comprises the component set (C), said apparatus performs the following operation (c):

(c) the developer layer regulating bias applying means changes the developer layer regulating bias to be applied, when the latent image in the fluctuation area is developed, correspondingly to an amount of a change in developing bias to be applied when the latent image in the fluctuation area is developed and changes the developer layer regulating bias to be applied, when the latent image in the non-fluctuation area is developed, correspondingly to an amount of a change in developing bias to be applied when the latent image in the non-fluctuation area is developed.

* * * * *